US012722762B2

(12) United States Patent
Ikegaya

(10) Patent No.: US 12,722,762 B2
(45) Date of Patent: Sep. 1, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 447 days.

(21) Appl. No.: 18/379,204

(22) Filed: Oct. 12, 2023

(65) Prior Publication Data

US 2024/0132190 A1 Apr. 25, 2024
US 2024/0228000 A9 Jul. 11, 2024

(30) Foreign Application Priority Data

Oct. 19, 2022 (JP) ..... 2022-167331

(51) Int. Cl.
*B63H 20/12* (2006.01)
*B63H 20/00* (2006.01)

(52) U.S. Cl.
CPC ..... *B63H 20/12* (2013.01); *B63H 20/007* (2013.01); *B63H 2020/003* (2013.01)

(58) Field of Classification Search
CPC ..... B63H 21/20; B63H 2021/202; B63H 2021/205; B63H 20/007; B63H 20/12; B63H 2020/003; B63H 2025/026; B63H 21/213; B63H 20/08; B63H 20/106; B63H 2021/216; B63H 21/21; B63H 25/42; B63H 21/17
See application file for complete search history.

(56) References Cited

U.S. PATENT DOCUMENTS 11,352,114 B2 6/2022 Osara et al.
2012/0101671 A1* 4/2012 Caouette ..... B63H 21/21 180/65.265
2015/0005995 A1 1/2015 Caouette
2021/0139123 A1* 5/2021 Osara ..... B63H 21/14

FOREIGN PATENT DOCUMENTS

JP 2010-125987 A 6/2010
JP 2016-119786 A 6/2016

OTHER PUBLICATIONS

Official Communication issued in corresponding European Patent Application No. 23202887.8 mailed on Apr. 9, 2024.

* cited by examiner

*Primary Examiner* — Andrew Polay
(74) *Attorney, Agent, or Firm* — Keating & Bennett, LLP

(57) ABSTRACT

A watercraft propulsion system includes an engine propulsion device attachable to a hull and including a propeller rotatable about a first propeller axis, an electric propulsion device attachable to the hull and including a propeller rotatable about a second propeller axis different from the first propeller axis, and a controller configured or programmed to control the engine propulsion device and the electric propulsion device. The controller is configured or programmed to perform a propulsive force matching control to match a propulsive force increasing characteristic of the electric propulsion device with a propulsive force increasing characteristic of the engine propulsion device when a command is inputted to simultaneously generate propulsive forces from the engine propulsion device and the electric propulsion device.

14 Claims, 15 Drawing Sheets

WATERCRAFT PROPULSION SYSTEM, AND WATERCRAFT

CROSS REFERENCE TO RELATED APPLICATIONS

This application claims the benefit of priority to Japanese Patent Application No. 2022-167331 filed on Oct. 19, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

JP-A 2016-119786 discloses a dual-axis electric propulsion watercraft including two propulsion electric motors. When the dual-axis electric propulsion watercraft is turned, a heavier load is exerted on the inner propulsion electric motor than on the outer propulsion electric motor due to the turning. If the torque of the inner propulsion electric motor reaches a torque limit, the torque of the inner propulsion electric motor is limited (inner torque limitation), and the target rotation speed of the outer propulsion electric motor is reduced. If the inner torque limitation is cancelled, the target rotation speed of the outer propulsion electric motor is reset to an original value. By thus reducing the target rotation speed of the outer propulsion electric motor in response to the inner torque limitation, a difference in rotation speed between the inner propulsion electric motor and the outer propulsion electric motor at the end of the turning can be reduced.

JP-A 2010-125987 discloses a hybrid watercraft propulsion device including a dual counter-rotating propeller configured such that a variable pitch propeller to be driven by a main device such as a diesel engine and a propulsion propeller to be driven by an electric motor are disposed in adjacent relation on the same straight line. The output of the main device is detected by a horsepower meter, and a function circuit outputs an electric motor input power reference value according to a horsepower signal generated by the horsepower meter. Based on the electric motor input power reference value, the electric motor is driven. Thus, a propulsive force generated by the main device and a propulsive force generated by the electric motor are set at a proper share ratio, so that the hybrid watercraft propulsion device can be efficiently operated by operating a single propulsion lever.

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

The inventor of preferred embodiments of the present invention conducted studies on a watercraft propulsion system including a plurality of propulsion devices attachable to a hull and respectively including propellers rotatable about different (noncoaxial) propeller axes. Particularly, the inventor conducted studies on a control operation to be performed to achieve a hull behavior by simultaneously driving the propulsion devices. A specific example of the hull behavior is a hull translation behavior such that the hull is translated without the bow turning. By balancing moments applied to the hull by the propulsive forces of the propulsion devices, the hull is able to be translated in the direction of the resultant force of the propulsive forces without the bow turning.

However, the propulsion devices do not necessarily have the same propulsive force increasing characteristics at the start of the generation of the propulsive forces. Where the watercraft propulsion system includes plural types of propulsion devices (e.g., an engine propulsion device and an electric propulsion device), for example, the propulsive forces generated by the propulsion devices are likely to effectively act on the hull at different timings, and change with time in different manners. Therefore, the transitional response of the hull to the generation of the propulsive forces, i.e., the transitional behavior of the hull, is different from that observed when the propulsive forces increase to plateau at stable levels. Therefore, the hull behavior at the start of the hull movement still has room for improvement.

In JP-A 2016-119786 and JP-A 2010-125987, there is no description of the aforementioned problem and, thus, no solution to the problem is provided.

Preferred embodiments of the present invention provide watercraft propulsion systems and watercraft that are each able to improve a hull behavior when propulsive forces generated by a plurality of propulsion devices are utilized in combination.

In order to overcome the previously unrecognized and unsolved challenges described above, a preferred embodiment of the present invention provides a watercraft propulsion system which includes an engine propulsion device attachable to a hull and including a propeller rotatable about a first propeller axis, an electric propulsion device attachable to the hull and including a propeller rotatable about a second propeller axis different from the first propeller axis, and a controller configured or programmed to control the engine propulsion device and the electric propulsion device and, when a command is inputted to simultaneously generate propulsive forces from the engine propulsion device and the electric propulsion device, to perform a propulsive force matching control to match the propulsive force increasing characteristic of the electric propulsion device with the propulsive force increasing characteristic of the engine propulsion device.

With this arrangement, when the propulsive forces are to be simultaneously generated from the engine propulsion device and the electric propulsion device, the propulsive force increasing characteristics of the engine propulsion device and the electric propulsion device are matched with each other. Thus, the propulsive forces of the engine propulsion device and the electric propulsion device are properly balanced (specifically, at a proper ratio) even in a transition period before the propulsive forces reach target propulsive force levels that are stabilized. Thus, a proper hull behavior is achieved. This improves the hull behavior when the propulsive forces of the plurality of propulsion devices (specifically, the engine propulsion device and the electric propulsion device) are utilized in combination.

In a preferred embodiment of the present invention, the propulsive force matching control includes a delay control to delay an increase of the propulsive force of the electric propulsion device. Thus, the increase of the propulsive force of the electric propulsion device is delayed so as to conform to the propulsive force increasing characteristic of the engine propulsion device such that the propulsive force increasing characteristics of the engine propulsion device and the electric propulsion device are matched with each other.

In a preferred embodiment of the present invention, the propulsive force matching control includes a filtering process in which the propulsive force increasing characteristic of the electric propulsion device is gradual.

In a preferred embodiment of the present invention, the propulsive force matching control includes a driving start delay control to delay the driving start timing of the electric propulsion device.

In a preferred embodiment of the present invention, the propulsive force matching control includes a driving start delay control to delay the driving start timing of the electric propulsion device, and a filtering process in which the propulsive force increasing characteristic of the electric propulsion device is gradual after the driving of the electric propulsion device is started.

In a preferred embodiment of the present invention, the propulsive force matching control includes a limitation control to maintain the propulsive force of the electric propulsion device at a constant propulsive force level that is lower than a target propulsive force level for a predetermined time period after the driving of the electric propulsion device is started.

In a preferred embodiment of the present invention, the watercraft propulsion system further includes a translation commander to input a translation command to the controller to translate the hull. The controller is configured or programmed to perform the propulsive force matching control when the translation command is inputted from the translation commander.

The hull translation is achieved by causing the plurality of propulsion devices to simultaneously generate the propulsive forces and moving the hull in the direction of the resultant force of the propulsive forces generated by the plurality of propulsion devices while cancelling moments applied to the hull by the plurality of propulsion devices. When the translation command is inputted, the propulsive force matching control is performed so that the propulsive force increasing characteristics of the plurality of propulsion devices (i.e., the engine propulsion device and the electric propulsion device) can be matched with each other. Thus, the hull is able to be properly translated even in the transition period before the propulsive forces increase to the target propulsive force levels immediately after the translation command is applied.

In a preferred embodiment of the present invention, the engine propulsion device and the electric propulsion device are attachable to the stern of the hull.

Another preferred embodiment of the present invention provides a watercraft propulsion system, which includes a first propulsion device attachable to a hull and including a propeller rotatable about a first propeller axis, and having a first propulsive force increasing characteristic, a second propulsion device attachable to the hull and including a propeller rotatable about a second propeller axis different from the first propeller axis, and having a second propulsive force increasing characteristic different from the first propulsive force increasing characteristic, and a controller configured or programmed to perform a propulsive force matching control to match the first propulsive force increasing characteristic and the second propulsive force increasing characteristic with each other when both the first propulsion device and the second propulsion device are to be driven.

With this arrangement, when propulsive forces are to be simultaneously generated from the first propulsion device and the second propulsion device, the propulsive force increasing characteristics of the first propulsion device and the second propulsion device are matched with each other. Thus, the propulsive forces of the first propulsion device and the second propulsion device are properly balanced (specifically, at a proper ratio) even in a transition period before the propulsive forces reach target propulsive force levels that are stabilized. Thus, a proper hull behavior is achieved. This improves the hull behavior when the propulsive forces of the plurality of propulsion devices are utilized in combination.

Further, another preferred embodiment of the present invention provides a watercraft which includes a hull, and a watercraft propulsion system provided on the hull and having any of the aforementioned features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
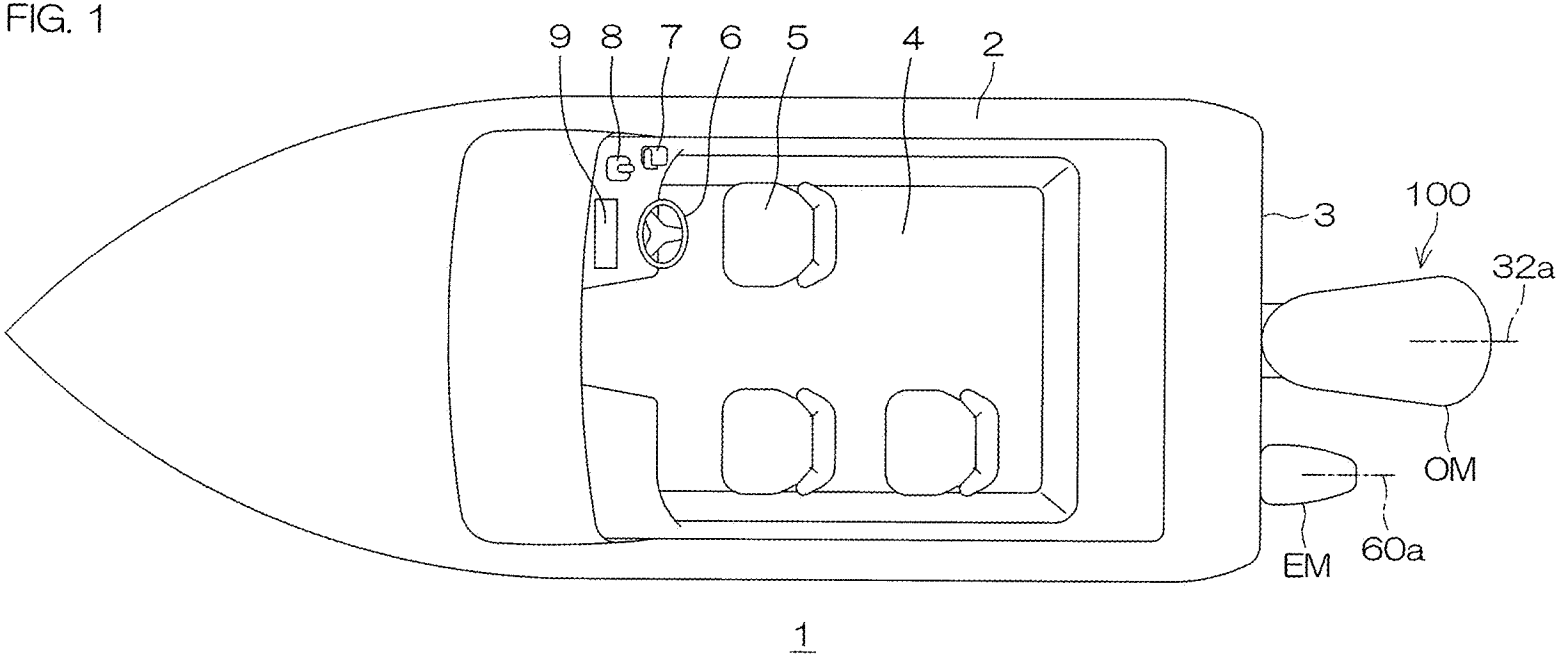
FIG. 1 is a plan view showing an exemplary construction of a watercraft mounted with a watercraft propulsion system according to a preferred embodiment of the present invention.
Figure 2:
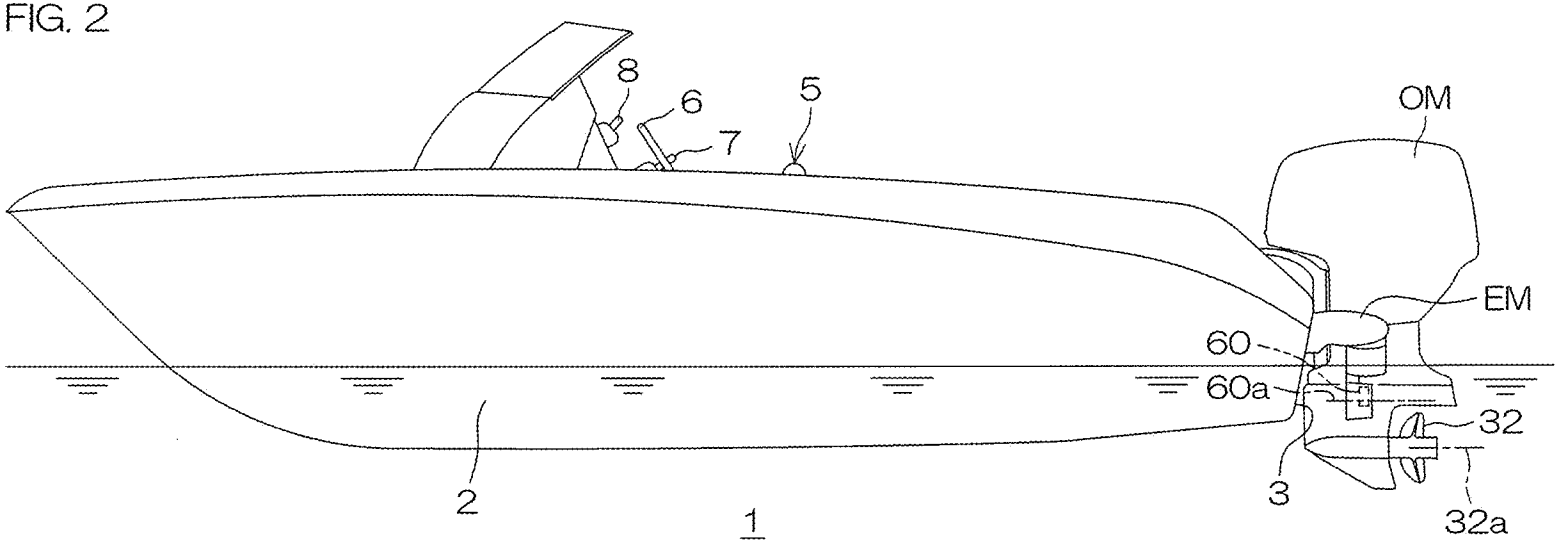
FIG. 2 is a side view of the watercraft as seen from a left side with respect to the bow direction of the watercraft.

FIG. 1 is a plan view showing an exemplary construction of a watercraft 1 mounted with a watercraft propulsion system 100 according to a preferred embodiment of the present invention. FIG. 2 is a side view of the watercraft 1 as seen from a left side with respect to the bow direction of the watercraft 1.

The watercraft 1 includes a hull 2, an engine outboard motor OM attached to the hull 2, and an electric outboard motor EM attached to the hull 2. The engine outboard motor OM and the electric outboard motor EM are exemplary propulsion devices. The engine outboard motor OM is an exemplary main propulsion device. The electric outboard motor EM is an exemplary auxiliary propulsion device having a lower rated output than the main propulsion device. The engine outboard motor OM is an exemplary engine propulsion device including an engine as its power source, and corresponds to the first propulsion device. The electric outboard motor EM is an exemplary electric propulsion device including an electric motor as its power source, and corresponds to the second propulsion device.

In the present preferred embodiment, the engine outboard motor OM and the electric outboard motor EM are attached to the stern 3 of the watercraft 1. More specifically, the engine outboard motor OM and the electric outboard motor EM are disposed side by side transversely of the hull 2 on the stern 3. In this example, the engine outboard motor OM is disposed on a transversely middle portion of the stern 3, and the electric outboard motor EM is disposed outward (leftward in this example) of the transversely middle portion of the stern 3.

The engine outboard motor OM includes a propeller 32 rotatable about a first propeller axis 32*a*. The electric outboard motor EM includes a propeller 60 (see FIGS. 4 and 5) rotatable about a second propeller axis 60*a*. The first propeller axis 32*a* and the second propeller axis 60*a* are not coaxial, but are different axes. In the present preferred embodiment, the first propeller axis 32*a* and the second propeller axis 60*a* are spaced apart from each other transversely of the hull 2 as seen in plan. Further, the first propeller axis 32*a* and the second propeller axis 60*a* are located at different height levels. The first propeller axis 32*a* extends in a direction conforming to the steering angle and the trim angle of the engine outboard motor OM. The second propeller axis 60*a* extends in a direction conforming to the steering angle and the trim angle of the electric outboard motor EM. Therefore, the first propeller axis 32*a* and the second propeller axis 60*a* may be parallel or nonparallel, and are not in a fixed relationship.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operation element operable by an operator to change the course of the watercraft 1. The remote control lever 7 is an operation element operable by the operator to change the magnitude (output) and the direction (forward or reverse direction) of the propulsive force of the engine outboard motor OM, and corresponds to an acceleration operation element. The joystick 8 is an operation element operable instead of the steering wheel 6 and the remote control lever 7 by the operator for watercraft maneuvering operation.

Figure 3:
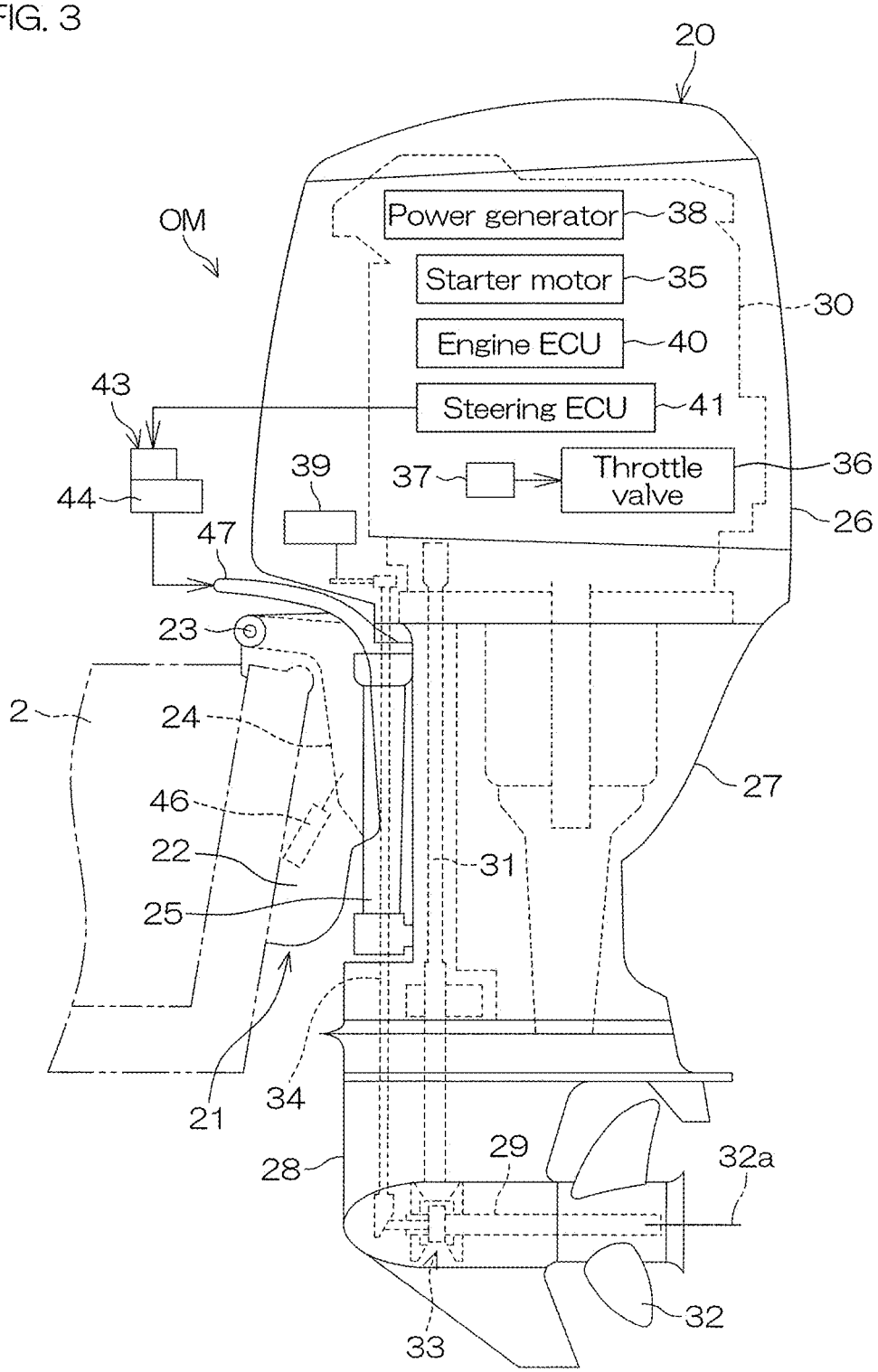
FIG. 3 is a side view showing the structure of an engine outboard motor by way of example.

FIG. 3 is a side view showing the structure of the engine outboard motor OM by way of example. The engine outboard motor OM includes a propulsion unit 20, and an attachment mechanism 21 that attaches the propulsion unit 20 to the hull 2. The attachment mechanism 21 includes a clamp bracket 22 detachably fixed to a transom plate provided on the stern 3 of the hull 2, and a swivel bracket 24 connected to the clamp bracket 22 pivotally about a tilt shaft 23 (horizontal pivot shaft). The propulsion unit 20 is attached to the swivel bracket 24 pivotally about a steering shaft 25. Thus, a steering angle (the azimuth angle of a propulsive force direction with respect to the center line of the hull 2) is changeable by pivoting the propulsion unit 20 about the steering shaft 25. Further, the trim angle of the propulsion unit 20 is changeable by pivoting the swivel bracket 24 about the tilt shaft 23. The trim angle is an angle at which the engine outboard motor OM is attached to the hull 2.

The housing of the propulsion unit 20 includes an engine cover (top cowling) 26, an upper case 27, and a lower case 28. An engine 30 is provided as a prime mover in the engine cover 26 with the axis of its crank shaft extending vertically. A drive shaft 31 for power transmission is connected to the lower end of the crank shaft of the engine 30, and extends vertically through the upper case 27 into the lower case 28.

The propeller 32 is provided as a propulsion member rotatably about the first propeller axis 32*a* at the lower rear side of the lower case 28. A propeller shaft 29, which is the rotation shaft of the propeller 32, extends horizontally along the first propeller axis 32*a* through the lower case 28. The rotation of the drive shaft 31 is transmitted to the propeller shaft 29 via a shift mechanism 33.

The shift mechanism 33 has a plurality of shift positions (shift states) including a forward shift position, a reverse shift position, and a neutral shift position. The neutral shift position corresponds to a cutoff state in which the rotation of the drive shaft 31 is not transmitted to the propeller shaft 29. The forward shift position corresponds to a state such that the rotation of the drive shaft 31 is transmitted to the propeller shaft 29 so as to rotate the propeller shaft 29 in a forward drive rotation direction. The reverse shift position corresponds to a state such that the rotation of the drive shaft 31 is transmitted to the propeller shaft 29 so as to rotate the propeller shaft 29 in a reverse drive rotation direction. The forward drive rotation direction is such that the propeller 32 is rotated so as to apply a forward propulsive force to the hull 2. The reverse drive rotation direction is such that the propeller 32 is rotated so as to apply a reverse propulsive force to the hull 2. The shift position of the shift mechanism 33 is switched by a shift rod 34. The shift rod 34 extends vertically parallel to the drive shaft 31, and is configured so as to be pivoted about its axis to operate the shift mechanism 33.

A starter motor 35 to start the engine 30, and a power generator 38 to generate electric power by the power of the engine 30 after the startup of the engine 30 are provided in association with the engine 30. The starter motor 35 is controlled by an engine ECU (Electronic Control Unit) 40. The electric power generated by the power generator 38 is supplied to electric components provided in the engine outboard motor OM and, in addition, is used to charge batteries 130, 145 (see FIG. 6) accommodated in the hull 2 (see FIGS. 1 and 2). Further, a throttle actuator 37 is provided in association with the engine 30. The throttle actuator 37 actuates the throttle valve 36 of the engine 30 so as to change the throttle opening degree of the engine 30 to change the intake air amount of the engine 30. The throttle actuator 37 may be an electric motor. The operation of the throttle actuator 37 is controlled by the engine ECU 40.

A shift actuator 39 that changes the shift position of the shift mechanism 33 is provided in association with the shift rod 34. The shift actuator 39 is, for example, an electric motor, and the operation of the shift actuator 39 is controlled by the engine ECU 40.

Further, a steering rod 47 is fixed to the propulsion unit 20, and a steering device 43 to be driven according to the operation of the steering wheel 6 (see FIG. 1) is connected to the steering rod 47. The steering device 43 pivots the propulsion unit 20 about the steering shaft 25 to perform a steering operation. The steering device 43 includes a steering actuator 44. The steering actuator 44 is controlled by a steering ECU 41. The steering ECU 41 may be provided in the propulsion unit 20. The steering actuator 44 may be an electric motor, or may be a hydraulic actuator.

A tilt/trim actuator 46 is provided between the clamp bracket 22 and the swivel bracket 24. The tilt/trim actuator 46 includes, for example, a hydraulic cylinder, and is controlled by the engine ECU 40. The tilt/trim actuator 46 pivots the swivel bracket 24 about the tilt shaft 23 to pivot the propulsion unit 20 about the tilt shaft 23.

Figure 4:
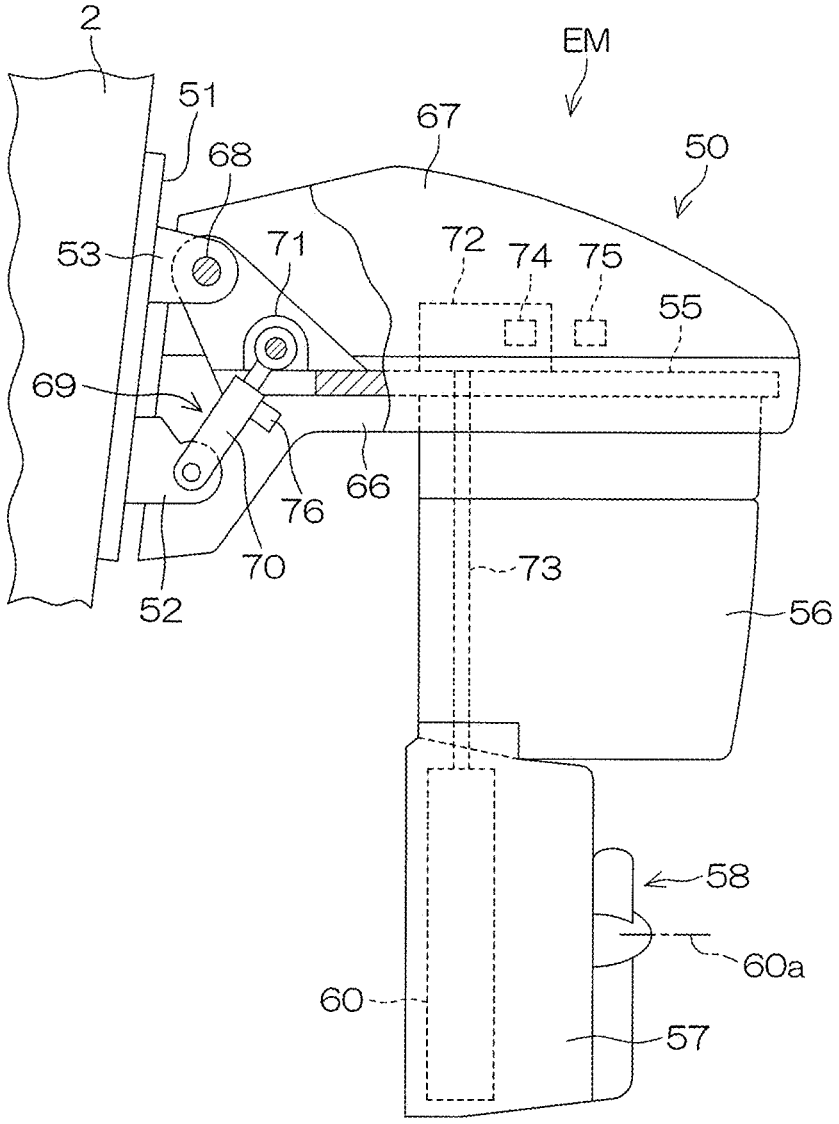
FIG. 4 is a side view showing the structure of an electric outboard motor by way of example.
Figure 5:
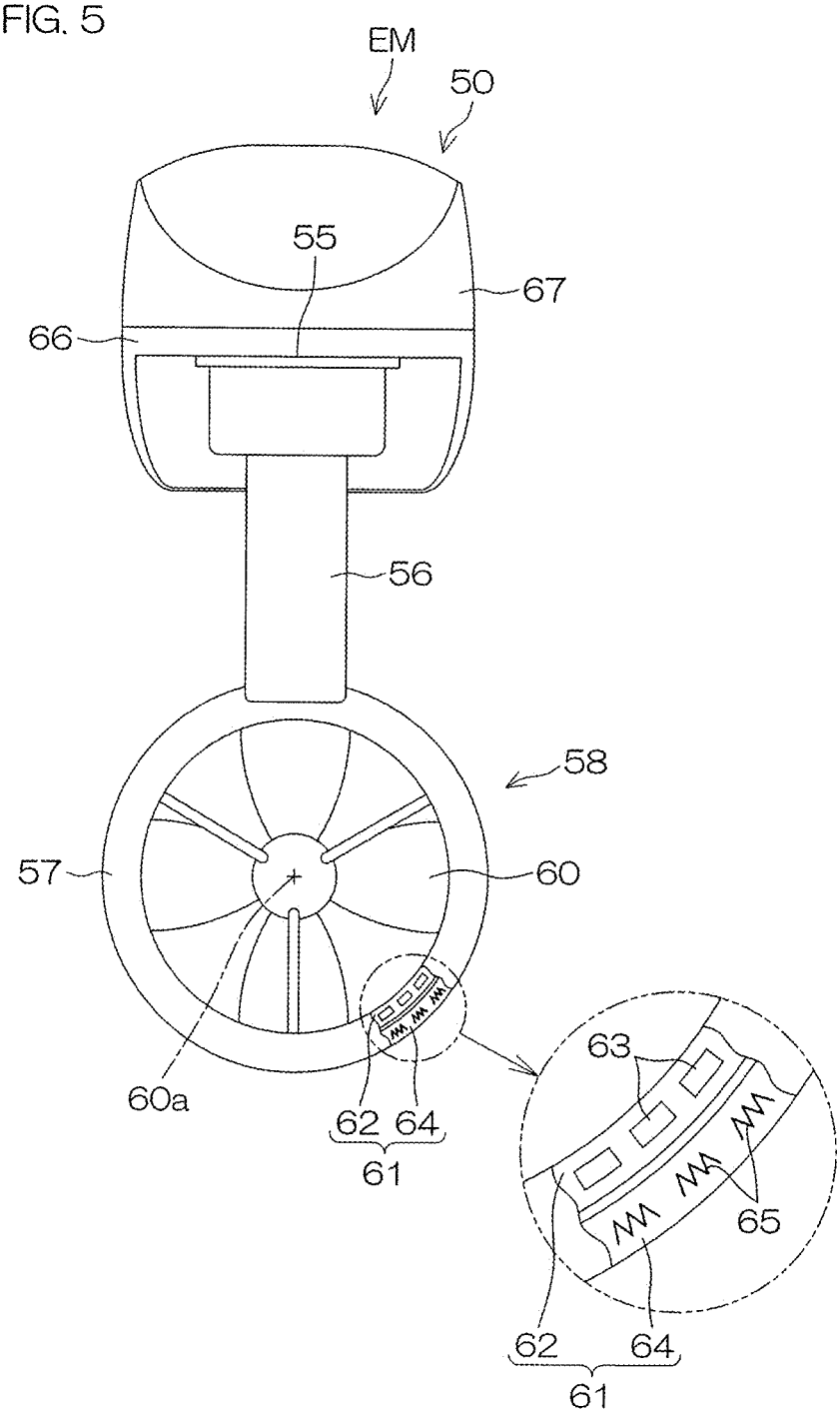
FIG. 5 is a rear view of the electric outboard motor as seen from the rear side of the watercraft.

FIG. 4 is a side view showing the structure of the electric outboard motor EM by way of example, and FIG. 5 is a rear view of the electric outboard motor EM as seen from the rear side of the watercraft 1.

The electric outboard motor EM includes a bracket 51 for attachment thereof to the hull 2, and a propulsion device body 50. The propulsion device body 50 is supported by the bracket 51. The propulsion device body 50 includes a base 55 supported by the bracket 51, an upper housing 56 extending downward from the base 55, a tubular (duct-shaped) lower housing 57 disposed below the upper housing 56, and a drive unit 58 disposed in the lower housing 57. The propulsion device body 50 further includes a cover 66 that covers the base 55 from the lower side, and a cowl 67 that covers the base 55 from the upper side. A tilt unit 69 and a steering unit 72 are accommodated in a space defined by the cover 66 and the cowl 67. Further, a buzzer 75 that generates sound when the tilt unit 69 is actuated may be accommodated in this space.

The drive unit 58 includes the propeller 60, and an electric motor 61 that rotates the propeller 60. The electric motor 61 includes a tubular rotor 62 to which the propeller 60 is fixed radially inward thereof, and a tubular stator 64 that surrounds the rotor 62 from the radially outside. The stator 64 is fixed to the lower housing 57, and the rotor 62 is supported rotatably with respect to the lower housing 57. The rotor 62 includes a plurality of permanent magnets 63 disposed circumferentially thereof. The stator 64 includes a plurality of coils 65 disposed circumferentially thereof. The rotor 62 is rotated by energizing the coils 65 such that the propeller 60 is correspondingly rotated about the second propeller axis 60*a* to generate a propulsive force.

The tilt unit 69 includes a tilt cylinder 70 as a tilt actuator. The tilt cylinder 70 may be a hydraulic cylinder of electric pump type adapted to pump a hydraulic oil by an electric pump. One of opposite ends of the tilt cylinder 70 is connected to the lower support portion 52 of the bracket 51, and the other end of the tilt cylinder 70 is connected to the base 55 via a cylinder connection bracket 71. A tilt shaft 68 is supported by the upper support portion 53 of the bracket 51, and the base 55 is connected to the bracket 51 via the tilt shaft 68 pivotally about the tilt shaft 68. The tilt shaft 68 extends transversely of the hull 2, so that the base 55 is pivotable upward and downward. Thus, the propulsion device body 50 is pivotable upward and downward about the tilt shaft 68.

An expression "tilt-up" means that the propulsion device body 50 is pivoted upward about the tilt shaft 68, and an expression "tilt-down" means that the propulsion device body 50 is pivoted downward about the tilt shaft 68. The tilt cylinder 70 is driven to be extended and retracted such that the tilt-up and the tilt-down are achieved. The propeller 60 is moved up to an above-water position by the tilt-up such that the propulsion device body 50 is brought into a tilt-up state. Further, the propeller 60 is moved down to an underwater position by the tilt-down such that the propulsion device body 50 is brought into a tilt-down state. Thus, the tilt unit 69 is an exemplary lift device that moves up and down the propeller 60.

A tilt angle sensor 76 is provided to detect a tilt angle (i.e., the angle of the propulsion device body 50 with respect to the bracket 51) to detect the tilt-up state and the tilt-down state of the propulsion device body 50. The tilt angle sensor 76 may be a position sensor that detects the position of the actuation rod of the tilt cylinder 70.

The steering unit 72 includes a steering shaft 73 connected to the lower housing 57 and the upper housing 56, and a steering motor 74. The steering motor 74 is an exemplary steering actuator that generates a drive force to pivot the steering shaft 73 about its axis. The steering unit 72 may further include a reduction gear that transmits the rotation of the steering motor 74 to the steering shaft 73 while decelerating the rotation of the steering motor 74. Thus, the lower housing 57 and the upper housing 56 are pivoted about the steering shaft 73 by driving the steering motor 74 such that the direction of the propulsive force generated by the drive unit 58 is changeable leftward and rightward. The upper housing 56 has a plate shape that extents anteroposteriorly of the hull 2 in a neutral steering position, and functions as a rudder plate to be steered by the steering unit 72.

Figure 6:
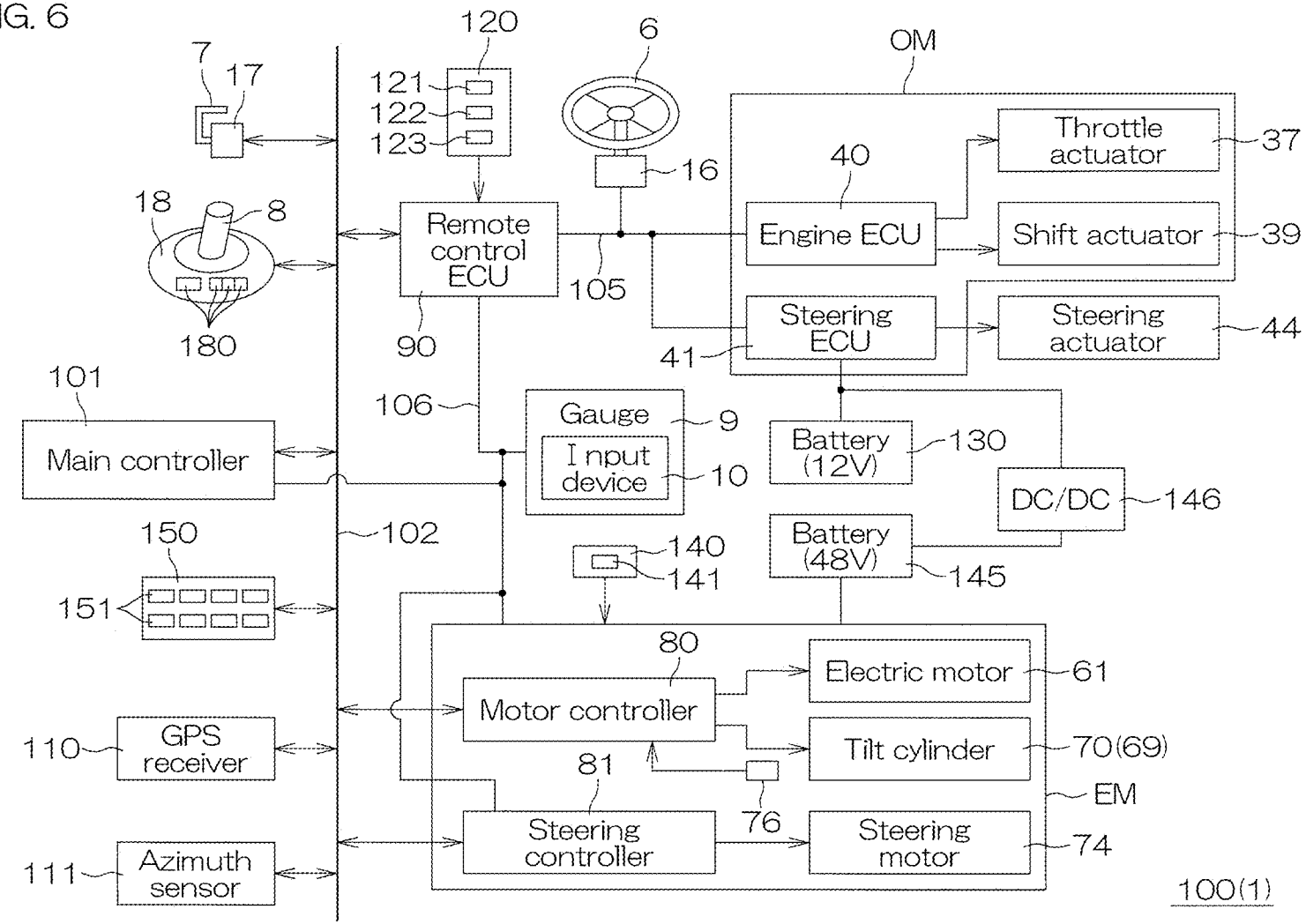
FIG. 6 is a block diagram showing the configuration of the watercraft propulsion system by way of example.

FIG. 6 is a block diagram showing an exemplary configuration of the watercraft propulsion system 100 provided in the watercraft 1. The watercraft propulsion system 100 includes the engine outboard motor OM as the main propulsion device, and the electric outboard motor EM as the auxiliary propulsion device. The watercraft propulsion system 100 includes the lift device to move up and down the propeller 60 of the electric outboard motor EM (see FIGS. 4 and 5) between the underwater position and the above-water position. In the present preferred embodiment, the tilt unit 69 provided in the electric outboard motor EM is an example of the lift device. The lift device such as the tilt unit 69 may be incorporated in the electric outboard motor EM, or may be provided separately from the electric outboard motor EM.

The watercraft propulsion system 100 includes a main controller 101. The main controller 101 is connected to an onboard network 102 (CAN: Control Area Network) provided in the hull 2. A remote control unit 17, a remote control ECU 90, a joystick unit 18, a GPS (Global Positioning System) receiver 110, an azimuth sensor 111, and the like are connected to the onboard network 102. The engine ECU 40 and the steering ECU 41 are connected to the remote control ECU 90 via an outboard motor control network 105. The main controller 101 transmits and receives signals to/from various units connected to the onboard network 102 to control the engine outboard motor OM and the electric outboard motor EM, and further controls other units. The main controller 101 has a plurality of control modes, and controls the units in predetermined manners according to the respective control modes.

A steering wheel unit 16 is connected to the outboard motor control network 105. The steering wheel unit 16 outputs an operation angle signal indicating the operation angle of the steering wheel 6 to the outboard motor control network 105. The operation angle signal is received by the remote control ECU 90 and the steering ECU 41. In response to the operation angle signal generated by the steering wheel unit 16 or a steering angle command applied from the remote control ECU 90, the steering ECU 41 correspondingly controls the steering actuator 44 to control the steering angle of the engine outboard motor OM.

The remote control unit 17 generates an operation position signal indicating the operation position of the remote control lever 7.

The joystick unit 18 generates an operation position signal indicating the operation position of the joystick 8, and generates an operation signal when one of operation buttons 180 of the joystick unit 18 is operated.

The remote control ECU 90 outputs a propulsive force command to the engine ECU 40 via the outboard motor control network 105. The propulsive force command includes a shift command that indicates the shift position of the shift mechanism 33, and an output command that indicates the output (specifically, the rotation speed) of the engine 30. Further, the remote control ECU 90 outputs the steering angle command to the steering ECU 41 via the outboard motor control network 105.

The remote control ECU 90 performs different control operations according to different control modes of the main controller 101. In a control mode for watercraft maneuvering with the use of the steering wheel 6 and the remote control lever 7, for example, the propulsive force command (the shift command and the output command) is generated according to the operation position signal generated by the remote control unit 17, and is applied to the engine ECU 40 by the remote control ECU 90. Further, the remote control ECU 90 commands the steering ECU 41 to conform to the operation angle signal generated by the steering wheel unit 16. In a control mode for watercraft maneuvering without the use of the steering wheel 6 and the remote control lever 7, on the other hand, the remote control ECU 90 conforms to commands applied by the main controller 101. That is, the main controller 101 generates the propulsive force command (the shift command and the output command) and the steering angle command, which are outputted to the engine ECU 40 and the steering ECU 41, respectively, by the remote control ECU 90. In a control mode for watercraft maneuvering with the use of the joystick 8, for example, the main controller 101 generates the propulsive force command (the shift command and the output command) and the steering angle command according to the signals generated by the joystick unit 18. The magnitude and the direction (the forward direction or the reverse direction) of the propulsive force of the engine outboard motor OM and the steering angle of the engine outboard motor OM are controlled according to the propulsive force command (the shift command and the output command) and the steering angle command thus generated.

The engine ECU 40 drives the shift actuator 39 according to the shift command to control the shift position, and drives the throttle actuator 37 according to the output command to control the throttle opening degree. The steering ECU 41 controls the steering actuator 44 according to the steering angle command to control the steering angle of the engine outboard motor OM.

The electric outboard motor EM includes a motor controller 80 and a steering controller 81 connected to the onboard network 102, and is configured to be actuated in response to commands applied from the main controller 101. The main controller 101 applies a propulsive force command and a steering angle command to the electric outboard motor EM. The propulsive force command includes a shift command and an output command. The shift command is a rotation direction command that indicates the stop of the propeller 60, the forward drive rotation of the propeller 60, or the reverse drive rotation of the propeller 60. The output command indicates a propulsive force to be generated, specifically the target value of the rotation speed of the propeller 60. The steering angle command indicates the target value of the steering angle of the electric outboard motor EM. The motor controller 80 controls the electric motor 61 according to the shift command (rotation direction command) and the output command. The steering controller 81 controls the steering motor 74 according to the steering angle command.

Further, the main controller 101 applies a tilt command to the motor controller 80 via the onboard network 102. The tilt command indicates the target value of the tilt angle of the electric outboard motor EM. The motor controller 80 actuates the tilt cylinder 70 according to the tilt command to tilt up or down the electric outboard motor EM to the target tilt angle. The detection signal of the tilt angle sensor 76 is inputted to the motor controller 80. Thus, the motor controller 80 can acquire the information of the tilt angle of the propulsion device body 50, and transmit the tilt angle information to the main controller 101.

The GPS receiver 110 detects the position of the watercraft 1 by receiving radio waves from an artificial satellite orbiting the earth, and outputs position data indicating the position of the watercraft 1 and speed data indicating the moving speed of the watercraft 1. The main controller 101 acquires the position data and the speed data, which are used to control and display the position and/or the azimuth of the watercraft 1.

The azimuth sensor 111 detects the azimuth of the watercraft 1, and generates azimuth data, which is used by the main controller 101.

The gauge 9 is connected to the main controller 101 via a control panel network 106. The gauge 9 is a display device that displays various information for the watercraft maneuvering. The gauge 9 is connected to the remote control ECU 90, the motor controller 80 and the steering controller 81 via the control panel network 106. Thus, the gauge 9 can display information such as of the operation state of the engine outboard motor OM, the operation state of the electric outboard motor EM, and the position and/or the azimuth of the watercraft 1. The gauge 9 may include an input device 10 such as touch panel and buttons. The input device 10 may be operated by the operator to set various settings and give various commands such that operation signals are outputted to the control panel network 106.

A power switch unit 120 operable to turn on a power supply to the engine outboard motor OM and to start and stop the engine 30 is connected to the remote control ECU 90. The power switch unit 120 includes a power switch 121 operable to turn on and off the power supply to the engine outboard motor OM, a start switch 122 operable to start the engine 30, and a stop switch 123 operable to stop the engine 30.

With the power switch 121 turned on, the remote control ECU 90 performs a power supply control to control the power supply to the engine outboard motor OM. Specifically, a power supply relay (not shown) provided between the battery 130 (e.g., 12 V) and the engine outboard motor OM is turned on. When the start switch 122 is operated with the power supply to the engine outboard motor OM turned on, the remote control ECU 90 applies a start command to the engine ECU 40. Thus, the engine ECU 40 actuates the starter motor 35 (see FIG. 3) to start the engine 30. During the operation of the engine 30, the battery 130 is charged with the electric power generated by the power generator 38 (see FIG. 3). When the stop switch 123 is operated during the operation of the engine 30, the remote control ECU 90 applies an engine stop command to the engine ECU 40. In response to the engine stop command, the engine ECU 40 performs a stop control operation to stop the engine 30. Engine outboard motor state information indicating whether or not the power supply to the engine outboard motor OM is turned on and whether or not the engine 30 is in operation is applied to the main controller 101 via the onboard network 102 by the remote control ECU 90.

A power switch unit 140 operable to turn on and off a power supply to the electric outboard motor EM is connected to the electric outboard motor EM. By turning on and off a power switch 141 provided in the power switch unit 140, a circuit connected between the electric outboard motor EM and the battery 145 (e.g., 48 V) that supplies the electric power to the electric outboard motor EM is closed and opened to turn on and off the power supply to the electric outboard motor EM. Electric outboard motor state information indicating whether or not the electric outboard motor EM is turned on, i.e., whether or not the electric outboard motor EM is in a drivable state, is applied to the main controller 101 via the onboard network 102 by the motor controller 80. The battery 145 is able to receive the electric power generated by the power generator 38 (see FIG. 3) of the engine outboard motor OM via a DC/DC convertor 146 (voltage transformer).

Further, an application switch panel 150 is connected to the onboard network 102. The application switch panel 150 includes a plurality of function switches 151 operable to apply predefined function commands. For example, the function switches 151 may include switches for automatic watercraft maneuvering commands. Specific examples of the function switches 151 may include switches for an automatic steering function of maintaining the azimuth of the watercraft 1, for an automatic steering function of maintaining the course of the watercraft 1, for an automatic steering function of causing the watercraft 1 to pass through a plurality of checkpoints sequentially, and for an automatic steering function of causing the watercraft 1 to sail along a predetermined pattern (zig-zag pattern, spiral pattern or the like). A function for the tilt-up or the tilt-down of the electric outboard motor EM may be assigned to one of the function switches 151.

The main controller 101 is able to control the engine outboard motor OM and the electric outboard motor EM in a plurality of control modes. The control modes include a plurality of modes each defined by the state of the engine outboard motor OM and the state of the electric outboard motor EM. Specific examples of the control modes include an electric mode, an engine mode, a dual mode, and an extender mode. The main controller 101 operates according to any one of these control modes based on the engine outboard motor state information and the electric outboard motor state information.

In the electric mode, the power supply to the electric outboard motor EM is turned on, and the power supply to the engine outboard motor OM is turned off. That is, only the electric outboard motor EM generates the propulsive force in the electric mode. In the engine mode, the engine 30 is in operation with the power supply to the engine outboard motor OM turned on, and the power supply to the electric outboard motor EM is turned off. That is, only the engine outboard motor OM generates the propulsive force in the engine mode. In the dual mode and the extender mode, the power supply to the electric outboard motor EM is turned on, and the engine 30 of the engine outboard motor OM is in operation. In the dual mode, the propulsive force generated by the engine outboard motor OM and the propulsive force generated by the electric outboard motor EM are both utilized. In the extender mode, only the propulsive force generated by the electric outboard motor EM is utilized, and the engine 30 is driven to generate the electric power to charge the battery 145. In the electric mode and the extender mode, the electric outboard motor EM generates the propulsive force likewise. The operator may set a setting or give a command to select the dual mode or the extender mode. For example, the operator may operate the input device 10 provided in the gauge 9 to set the setting or give the command.

Figure 7:
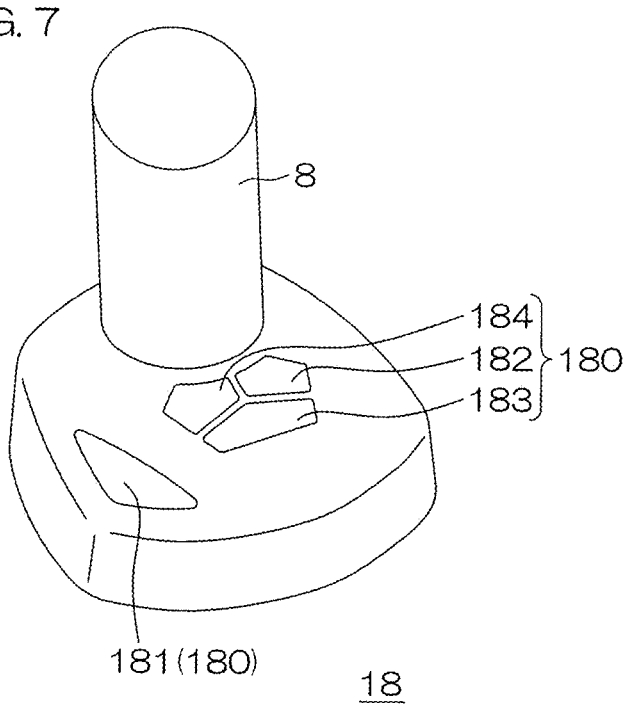
FIG. 7 is a perspective view showing the structure of a joystick unit by way of example.

FIG. 7 is a perspective view showing the structure of the joystick unit 18 by way of example. The joystick unit 18 includes the joystick 8, which is inclinable forward, backward, leftward, and rightward (i.e., in all 360-degree directions) and is pivotable (twistable) about its axis. In this example, the joystick unit 18 further includes a plurality of operation buttons 180. The operation buttons 180 include a joystick button 181 and holding mode setting buttons 182 to 184.

The joystick button 181 is an operation element operable by the operator to select a control mode (watercraft maneuvering mode) utilizing the joystick 8, i.e., a joystick mode.

The holding mode setting buttons 182, 183, 184 are operation buttons operable by the operator to select position/azimuth holding system control modes (examples of the holding mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 101 can be classified into an ordinary mode, the joystick mode, or the holding mode in terms of operation system.

In the ordinary mode, a steering control operation is performed according to the operation angle signal generated by the steering wheel unit 16, and a propulsive force control operation is performed according to the operation signal (operation position signal) of the remote control lever 7. In the present preferred embodiment, the ordinary mode is a default control mode of the main controller 101. In the steering control operation, specifically, the steering ECU 41 drives the steering actuator 44 according to the operation angle signal generated by the steering wheel unit 16 or the steering angle command applied from the remote control ECU 90. Thus, the body of the engine outboard motor OM is steered leftward and rightward such that the propulsive force direction is changed leftward and rightward with respect to the hull 2. In the propulsive force control operation, specifically, the engine ECU 40 drives the shift actuator 39 and the throttle actuator 37 according to the propulsive force command (the shift command and the output command) applied to the engine ECU 40 by the remote control ECU 90. Thus, the shift position of the engine outboard motor OM is set to the forward shift position, the reverse shift position, or the neutral shift position, and the engine output (specifically, the engine rotation speed) is changed.

In the joystick mode, the steering control operation and the propulsive force control operation are performed according to the operation signal of the joystick 8 of the joystick unit 18.

In the joystick mode, the steering control operation and the propulsive force control operation are performed on the engine outboard motor OM if the engine outboard motor OM is in a propulsive force generatable state. That is, the main controller 101 applies the steering angle command and the propulsive force command to the remote control ECU 90, and the remote control ECU 90 applies the steering angle command and the propulsive force command to the steering ECU 41 and the engine ECU 40, respectively.

In the joystick mode, the steering control operation and the propulsive force control operation are performed on the electric outboard motor EM if the electric outboard motor EM is in a propulsive force generatable state. In the steering control operation on the electric outboard motor EM, specifically, the steering controller 81 of the electric outboard motor EM drives the steering unit 72 according to the steering angle command applied to the steering controller 81 by the main controller 101. Thus, the drive unit 58 and the upper housing 56 of the electric outboard motor EM are pivoted leftward and rightward such that the propulsive force direction is changed leftward and rightward with respect to the hull 2. In the propulsive force control operation on the electric outboard motor EM, specifically, the motor controller 80 of the electric outboard motor EM controls the rotation direction and the rotation speed of the electric motor 61 according to the propulsive force command (the shift command and the output command) applied to the motor controller 80 by the main controller 101. Thus, the rotation direction of the propeller 60 is set to a forward drive rotation direction or a reverse drive rotation direction, and the rotation speed of the propeller 60 is changed.

Figure 8B:
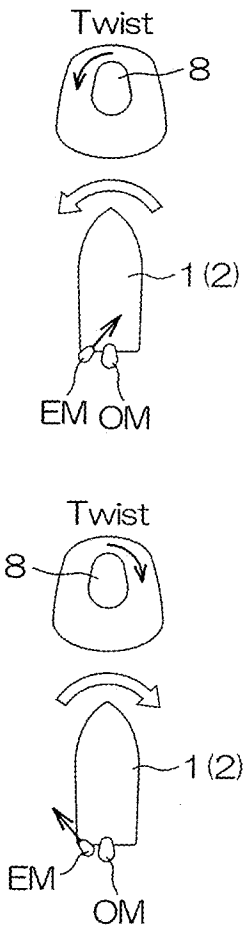
FIGS. 8A and 8B are diagrams for describing exemplary operations to be performed in a first joystick mode by utilizing the propulsive forces of two propulsion devices.
Figure 8A:
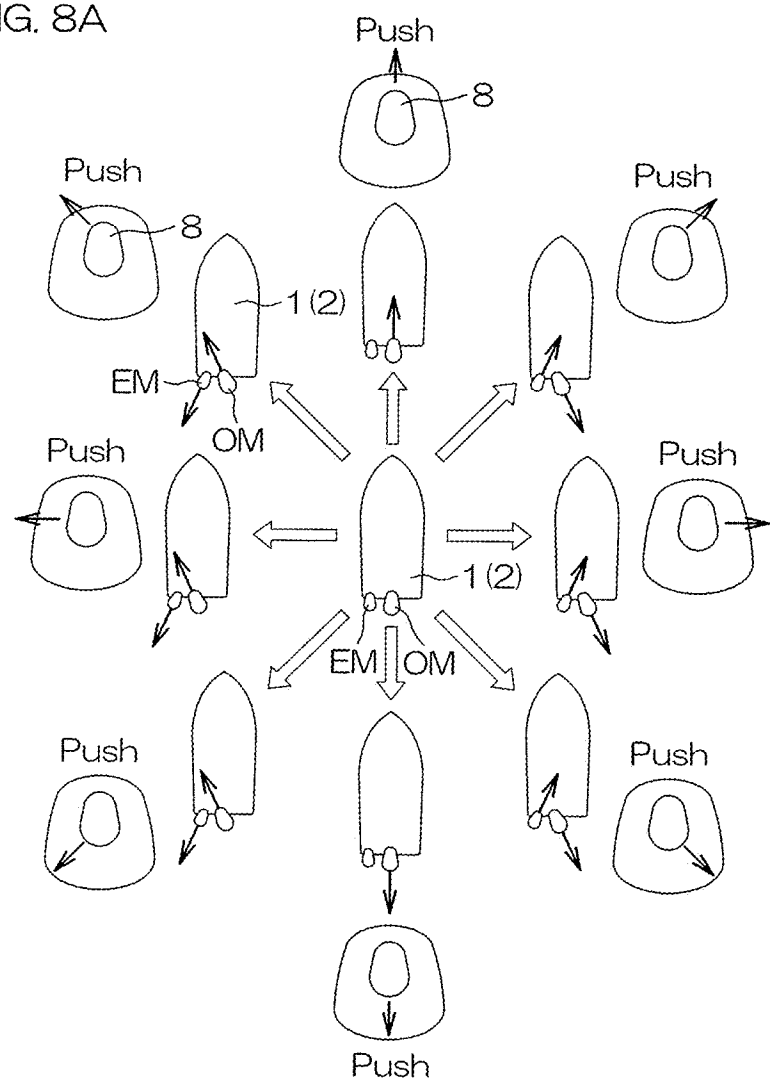
Figure 9:
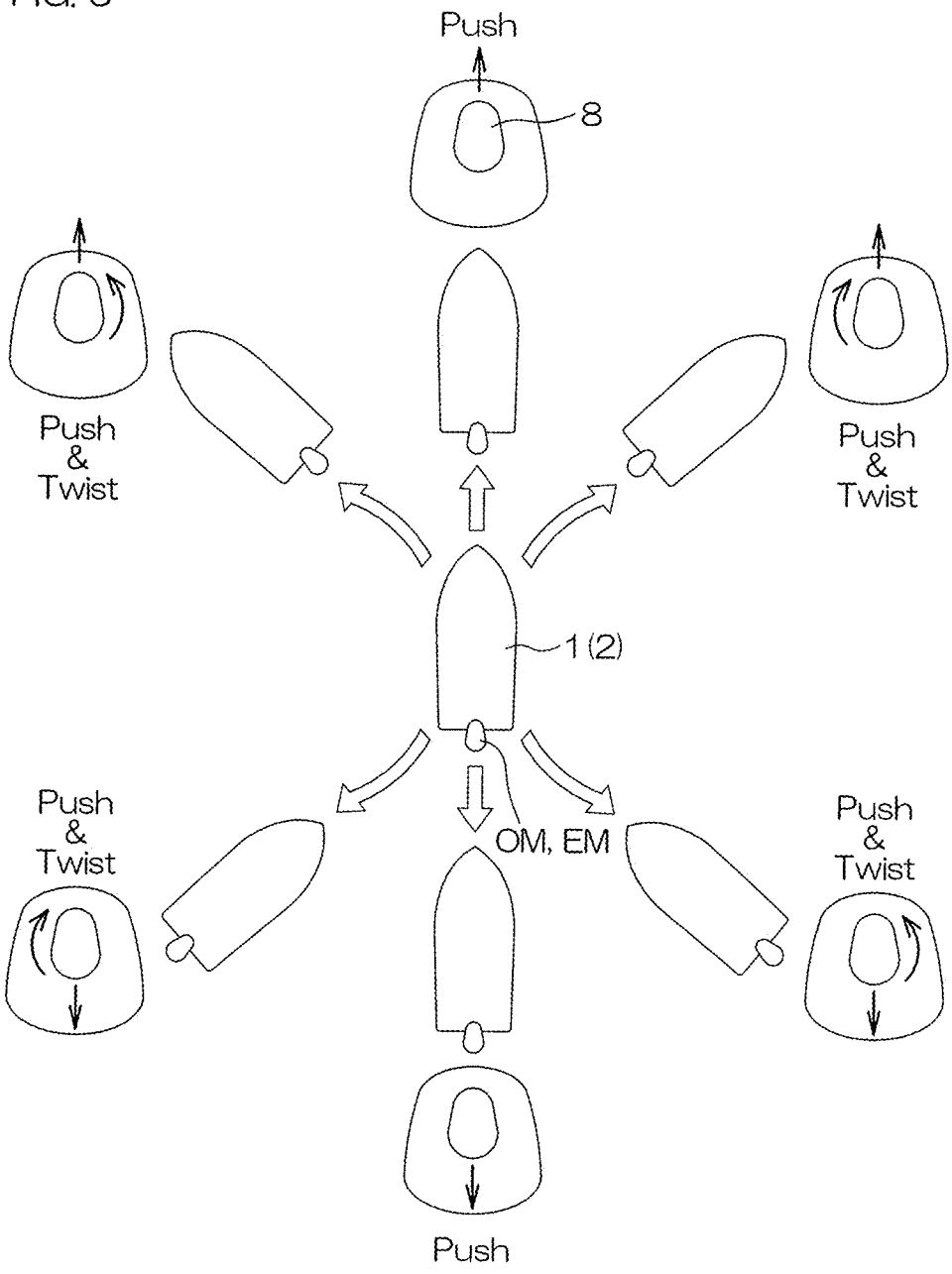
FIG. 9 is a diagram for describing an exemplary operation to be performed in a second joystick mode by utilizing the propulsive force of a single propulsion device.

FIGS. 8A, 8B, and 9 are diagrams for describing two types of joystick modes and showing the operation states of the joystick 8 and the corresponding behaviors of the hull 2. More specifically, FIGS. 8A and 8B show exemplary operations to be performed in a first joystick mode in which propulsive forces generated by the two propulsion devices (in the present preferred embodiment, the engine outboard motor OM and the electric outboard motor EM) are both utilized. FIG. 9 shows an exemplary operation to be performed in a second joystick mode in which a propulsive force generated by only one of the propulsion devices (in the present preferred embodiment, one of the engine outboard motor OM and the electric outboard motor EM) is utilized.

When the joystick mode is commanded by operating the joystick button 181 in the dual mode, the main controller 101 performs the control operation according to the first joystick mode. When the joystick mode is commanded by operating the joystick button 181 in any one of the modes other than the dual mode (the electric mode, the engine mode, or the extender mode), the main controller 101 performs the control operation according to the second joystick mode.

In the first joystick mode shown in FIGS. 8A and 8B, the main controller 101 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 101 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 101 and inputted to the remote control ECU 90 and to the steering controller 81 and the motor controller 80 of the electric outboard motor EM. The remote control ECU 90 transmits the steering angle command and the propulsive force command to the steering ECU 41 and the engine ECU 40, respectively, of the engine outboard motor OM. Thus, the engine outboard motor OM is steered to a steering angle according to the steering command, and the shift position and the engine rotation speed of the engine outboard motor OM are controlled so as to generate a propulsive force according to the propulsive force command. Further, the drive unit 58 and the upper housing 56 of the electric outboard motor EM are steered to a steering angle according to the steering command, and the rotation direction and the rotation speed of the electric motor 61 of the electric outboard motor EM are controlled so as to generate a propulsive force according to the propulsive force command.

When the joystick 8 is inclined without being pivoted in the first joystick mode, the hull 2 is moved in a direction corresponding to the inclination direction of the joystick 8 without the bow turning, i.e., with its azimuth maintained. That is, the hull 2 is in a hull behavior of translation movement. Examples of the translation movement are shown in FIG. 8A. In general, the translation movement is typically achieved by driving one of the two propulsion devices forward and driving the other propulsion device reverse with the propulsive force action lines of the two propulsion devices (extending along the respective propulsive force directions) crossing each other in the hull 2. Thus, the hull 2 is translated in the direction of the resultant force of the propulsive forces generated by the two outboard motors OM, EM. The hull 2 can be laterally translated, for example, by causing the engine outboard motor OM and the electric outboard motor EM to generate propulsive forces of the same magnitude with one of the engine outboard motor OM and the electric outboard motor EM driven forward and with the other of the engine outboard motor OM and the electric outboard motor EM driven reverse. In the examples shown in FIG. 8A, however, only the propulsive force of the engine outboard motor OM is utilized to move the hull 2 forward in the bow direction and rearward in the stern direction.

When the joystick 8 is pivoted (twisted) without being inclined in the first joystick mode, the bow of the hull 2 is turned in a direction corresponding to the pivoting direction of the joystick 8 without any substantial position change. That is, the hull 2 is in a fixed-point bow turning behavior. Examples of the fixed-point bow turning behavior are shown in FIG. 8B. In these examples, only the propulsive force of the electric outboard motor EM is utilized for the fixed-point bow turning behavior.

When the joystick 8 is inclined and pivoted in the first joystick mode, the hull 2 is in a hull behavior such that the bow is turned in a direction corresponding to the pivoting direction of the joystick 8 while the hull 2 is moved in a direction corresponding to the inclination direction of the joystick 8. In general, however, the watercraft maneuvering operation can be more easily performed by inclining the joystick 8 for the hull translation (see FIG. 8A) for the adjustment of the position of the hull 2 and by pivoting the joystick 8 for the fixed-point bow turning (see FIG. 8B) for the adjustment of the azimuth of the hull 2.

In the second joystick mode shown in FIG. 9, the propulsive force generated by only one of the two propulsion devices is utilized and, therefore, the hull translation (see FIG. 8A) which utilizes the resultant force of the propulsive forces of the two propulsion devices is impossible. That is, the second joystick mode is a control mode that disables a certain hull behavior (specifically, the translation movement) available in the first joystick mode. In the examples shown in FIG. 8B, only the propulsive force of the electric outboard motor EM is utilized, so that the fixed-point bow turning behavior is available not only in the dual mode but also in the electric mode and the extender mode.

In the second joystick mode, the main controller 101 defines the anteroposterior inclination of the joystick 8 as the propulsive force command (the shift command and the output command), and ignores the lateral inclination of the joystick 8. That is, when the joystick 8 is inclined, only the anteroposterior directional component of the inclination direction of the joystick 8 serves as an effective input, and is defined as the propulsive force command. More specifically, if the anteroposterior directional component has a value indicating the forward inclination, the anteroposterior directional component is defined as a forward shift command. If the anteroposterior directional component has a value indicating the rearward inclination, the anteroposterior directional component is defined as a reverse shift command. Further, the magnitude of the anteroposterior directional component is defined as a command (output command) indicating the magnitude of the propulsive force. The propulsive force command (the shift command and the output command) thus defined is inputted from the main controller 101 to the remote control ECU 90 (in the engine mode) or to the motor controller 80 (in the electric mode or the extender mode). On the other hand, the main controller 101 defines the axial pivoting of the joystick 8 as the steering angle command in the second joystick mode. That is, the main controller 101 generates the steering angle command according to the axial pivoting direction and the pivoting amount of the joystick 8, and inputs the steering angle command to the remote control ECU 90 (in the engine mode) or to the steering controller 81 (in the electric mode or the extender mode).

In the engine mode, the remote control ECU 90 transmits the steering angle command and the propulsive force command to the steering ECU 41 and the engine ECU 40, respectively. Thus, the engine outboard motor OM is steered to a steering angle according to the steering angle command, and the shift position and the engine rotation speed of the engine outboard motor OM are controlled so as to generate a propulsive force according to the propulsive force command. In the electric mode or the extender mode, the motor controller 80 drives the electric motor 61 according to the propulsive force command, and the steering controller 81 drives the steering motor 74 according to the steering angle command.

The fixed point holding mode (Stay Point™), the position holding mode (Fish Point™) and the azimuth holding mode (Drift Point™) to be selected by operating the holding mode setting buttons 182, 183 and 184, respectively, are examples of the holding mode. In these holding modes, the outputs and the steering angles of the engine outboard motor OM and/or the electric outboard motor EM are controlled without any manual operation by the operator.

In the fixed point holding mode (Stay Point™), for example, the main controller 101 controls the outputs and the steering angles of the engine outboard motor OM and the electric outboard motor EM based on the position data and the speed data generated by the GPS receiver 110 and the azimuth data outputted from the azimuth sensor 111. Thus, the positional change and the azimuthal change of the hull 2 are reduced. The fixed point holding mode is available in the dual mode.

In the position holding mode (Fish Point™), the main controller 101 controls the output and the steering angle of at least one of the engine outboard motor OM and the electric outboard motor EM based on the position data and the speed data generated by the GPS receiver 110. Thus, the positional change of the hull 2 is reduced.

In the azimuth holding mode (Drift Point™), the main controller 101 controls the output and the steering angle of at least one of the engine outboard motor OM and the electric outboard motor EM based on the azimuth data generated by the azimuth sensor 111. Thus, the azimuthal change of the hull 2 is reduced.

The position holding mode and the azimuth holding mode are available in any of the electric mode, the engine mode, the dual mode, and the extender mode.

Figure 10A:
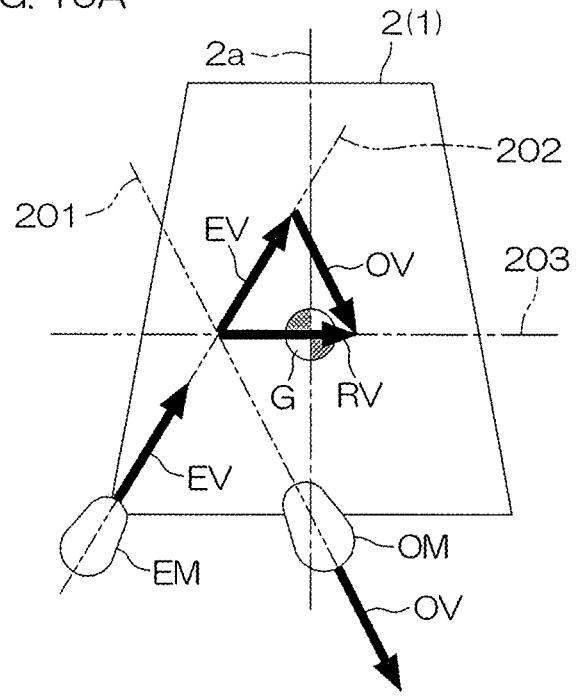
FIGS. 10A and 10B are vector diagrams each showing lateral translation movement, i.e., showing a relationship between propulsive forces for the lateral movement.
Figure 10B:
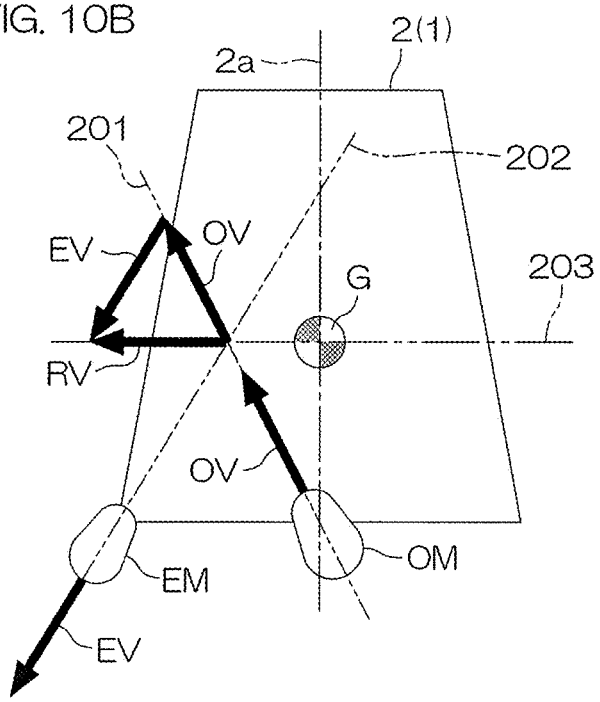

FIGS. 10A and 10B are vector diagrams showing lateral translation movement, i.e., showing a relationship between the propulsive forces for the lateral movement.

The lateral movement includes a rightward translation movement and a leftward translation movement in the first joystick mode. When the operator inclines the joystick 8 rightward, the joystick unit 18 generates a rightward lateral movement command (an example of the first lateral movement command) for the rightward lateral movement. When the operator inclines the joystick 8 leftward, the joystick unit 18 generates a leftward lateral movement command (an example of the second lateral movement command) for the leftward lateral movement. When the rightward lateral movement command is inputted, the main controller 101 performs a rightward lateral movement control (an example of the first lateral movement control) to control the engine outboard motor OM and the electric outboard motor EM for the rightward lateral movement. When the leftward lateral movement command is inputted, the main controller 101 performs a leftward lateral movement control (an example of the second lateral movement control) to control the engine outboard motor OM and the electric outboard motor EM for the leftward lateral movement.

FIG. 10A shows the rightward lateral movement control by way of example. The engine outboard motor OM, which is a right one of the two propulsion devices, is controlled to generate a reverse propulsive force with its shift position set at the reverse shift position. The electric outboard motor EM, which is a left one of the two propulsion devices, is controlled to be driven forward to generate a forward propulsive force. On the other hand, the engine outboard motor OM and the electric outboard motor EM are steered to move their rear ends away from each other. Thus, the steering angles of the engine outboard motor OM and the electric outboard motor EM are controlled so that propulsive force action lines 201, 202 respectively defined by lines extending along the vectors OV, EV of the propulsive forces generated by the engine outboard motor OM and the electric outboard motor EM cross each other in the hull 2 as seen in plan. At this time, the resultant force of the propulsive forces generated by the two propulsion devices may be considered to act on the hull 2 at the intersection of the two propulsive force action lines 201, 202. Where a resultant force action line 203 defined by a line extending along the vector RV of the resultant force passes through the turning center G of the hull 2, the resultant force applies no moment to the hull 2 so that the hull 2 can translate. Where the resultant force action line 203 passing through the turning center G is parallel to the transverse direction of the hull 2, the hull 2 can be moved laterally rightward. The steering angles, the forward/reverse drive directions, and the outputs of the engine outboard motor OM and the electric outboard motor EM are thus controlled in the rightward lateral movement control. In FIGS. 10A and 10B, the turning center G is located on the anteroposterior center line 2*a* of the hull 2 by way of example, but the position of the turning center G is generally unknown.

Similarly, FIG. 10B shows the leftward lateral movement control by way of example. The engine outboard motor OM, which is a right one of the two propulsion devices, is controlled to generate a forward propulsive force with its shift position set at the forward shift position. The electric outboard motor EM, which is a left one of the two propulsion devices, is controlled to be driven reverse to generate a reverse propulsive force. On the other hand, the engine outboard motor OM and the electric outboard motor EM are steered to move their rear ends away from each other. Thus, the steering angles of the engine outboard motor OM and the electric outboard motor EM are controlled so that the propulsive force action lines 201, 202 defined by the lines extending along the vectors OV, EV of the propulsive forces generated by the engine outboard motor OM and the electric outboard motor EM cross each other in the hull 2 as seen in plan. As in the case of FIG. 10A, the resultant force of the propulsive forces generated by the two propulsion devices may be considered to act on the hull 2 at the intersection of the two propulsive force action lines 201, 202. Where the resultant force action line 203 defined by the line extending along the vector RV of the resultant force passes through the turning center G of the hull 2, the resultant force applies no moment to the hull 2, so that the hull 2 can translate. Where the resultant force action line 203 passing through the turning center G is parallel to the transverse direction of the hull 2, the hull 2 can be moved laterally leftward. The steering angles, the forward/reverse drive directions and the outputs of the engine outboard motor OM and the electric outboard motor EM are thus controlled in the leftward lateral movement control.

Figure 11:
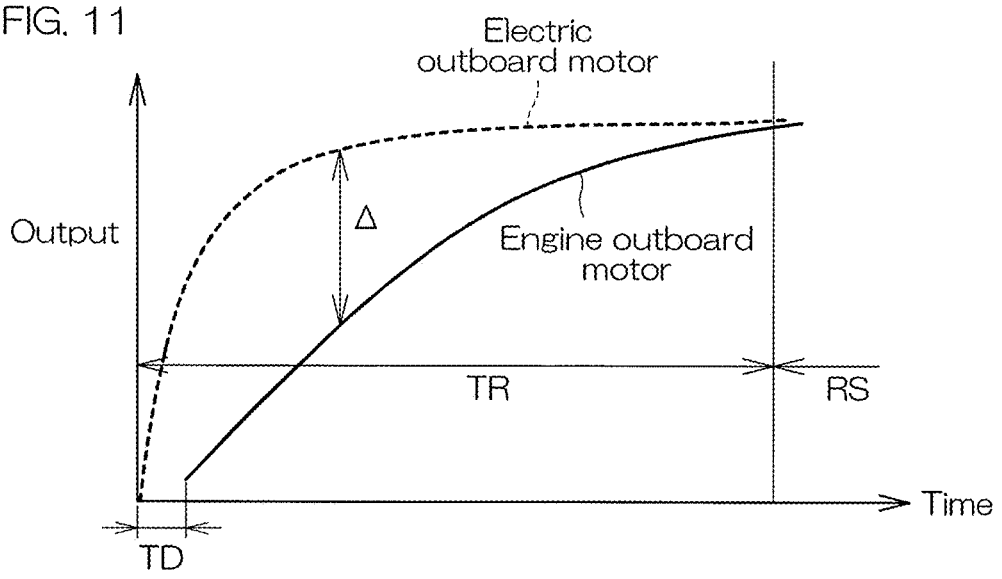
FIG. 11 is a characteristic diagram showing the propulsive force increasing characteristics of the electric outboard motor and the engine outboard motor by way of example.

FIG. 11 shows the propulsive force increasing characteristics of the electric outboard motor EM and the engine outboard motor OM by way of example, particularly showing changes in propulsive force magnitude (output) with time after the propulsive force generation command is applied. Where the electric outboard motor EM immediately responds to the propulsive force command, the electric motor 61 of the electric outboard motor EM immediately starts rotating, and its rotation speed quickly increases. In the engine outboard motor OM, in contrast, the shift mechanism 33 is actuated in response to the propulsive force command, and is shifted in with a delay time TD after the actuation. Further, the increasing characteristic of the engine rotation speed after the actuation of the throttle actuator 37 and the like is more gradual than the increasing characteristic of the rotation speed of the electric motor 61 of the electric outboard motor EM. Therefore, even if the electric outboard motor EM and the engine outboard motor OM are simultaneously commanded to generate the propulsive forces of the same magnitude, there is a magnitude difference (output gap) A between the propulsive force generated by the electric outboard motor EM and the propulsive force generated by the engine outboard motor OM in an increasing period TR before the propulsive forces are plateaued. In the control mode utilizing both the engine outboard motor OM and the electric outboard motor EM, therefore, a stable hull behavior is provided in a plateau period PS in which the magnitudes (outputs) of the propulsive forces are both plateaued. This is also true for the translation movement such as the lateral movement.

Figure 12:
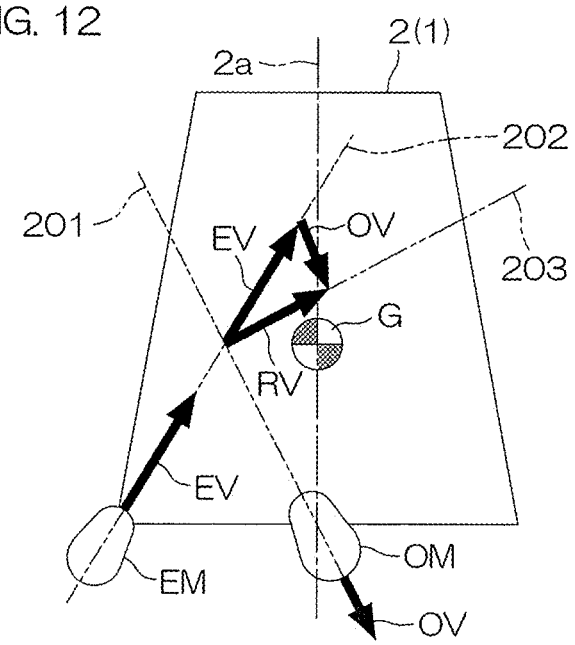
FIG. 12 is a vector diagram for describing propulsive forces acting on a hull at the initial stage of the translation movement when a propulsive force matching control is not performed.

As described with reference to FIGS. 10A and 10B, it is important that the action line 203 of the vector RV of the resultant force of the propulsive forces applied to the hull 2 from the engine outboard motor OM and the electric outboard motor EM passes through the turning center G in the translation movement such as the lateral movement. As described with reference to FIG. 11, however, the engine outboard motor OM and the electric outboard motor EM have different propulsive force increasing characteristics, so that the propulsive force of the electric outboard motor EM is excessively great (in other words, the propulsive force of the engine outboard motor OM is excessively small) in the increasing period TR before the plateau period PS. Therefore, the action line 203 of the vector RV of the resultant force may not pass through the turning center G as shown in FIG. 12. More specifically, the action line 203 of the vector RV of the resultant force for the lateral movement may not extend parallel to the transverse direction of the hull 2. Accordingly, the vector RV of the resultant force applies a moment to the hull 2 about the turning center G such that the bow of the hull 2 may be turned.

Figure 13:
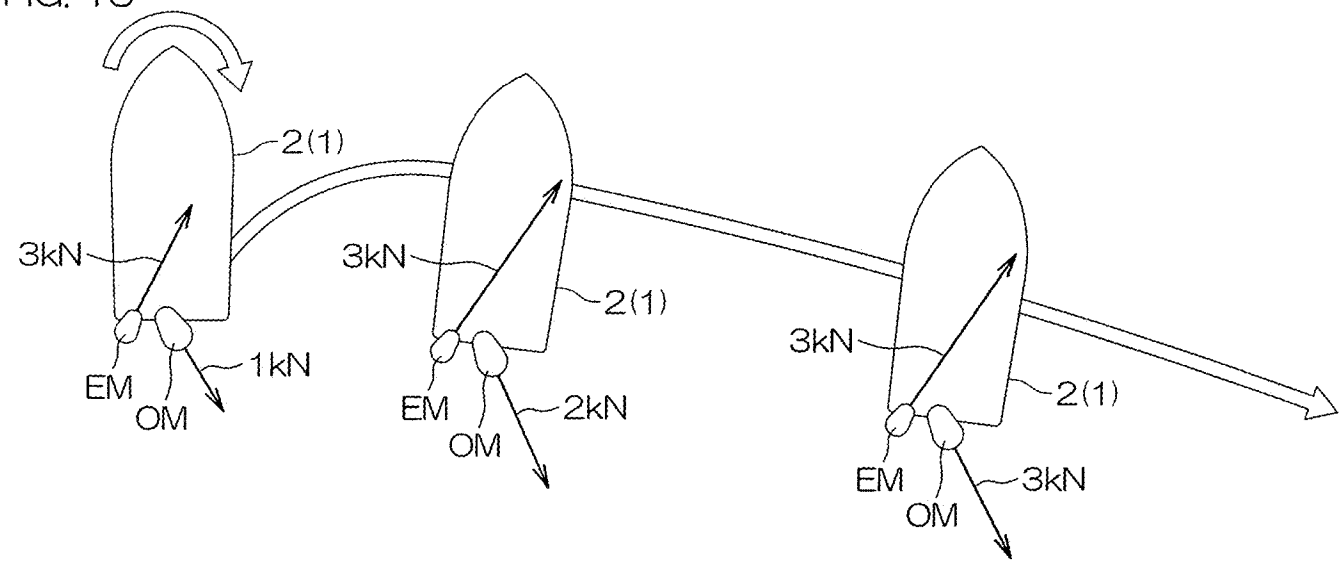
FIG. 13 is a diagram showing an exemplary hull behavior observed when the propulsive force matching control is not performed.

Specifically, when the joystick 8 is inclined laterally for the lateral movement (e.g., the rightward lateral movement), the hull 2 is moved obliquely forward with its bow turned, as shown in FIG. 13, due to the excessively great propulsive force of the electric outboard motor EM at the initial stage of the lateral movement. In the example of FIG. 13, an output command (target output value) indicating the magnitude of the propulsive force is set to 3 kN, for example, in each of the propulsive force commands applied to the electric outboard motor EM and the engine outboard motor OM. Immediately after the joystick 8 is operated, the output of the electric outboard motor EM quickly reaches 3 kN, for example, but the output of the engine outboard motor OM is, for example, 1 kN and then is gradually increased. When the magnitudes of the propulsive forces of the electric outboard motor EM and the engine outboard motor OM thereafter reach their target output values (e.g., 3 kN) to be plateaued (settled), the vector RV of the resultant force is parallel to the transverse direction of the hull 2 (FIGS. 10A and 10B), so that the hull 2 will translate laterally. When the hull 2 is brought into the translation movement state, however, the movement direction of the hull 2 is oblique with respect to the transverse direction of the hull 2 of the initial attitude due to the initial oblique forward movement and the initial bow turning of the hull 2. Therefore, the operator may need to stop the lateral movement operation, and to operate the joystick 8 to correct the position and the azimuth of the hull 2.

Figure 14:
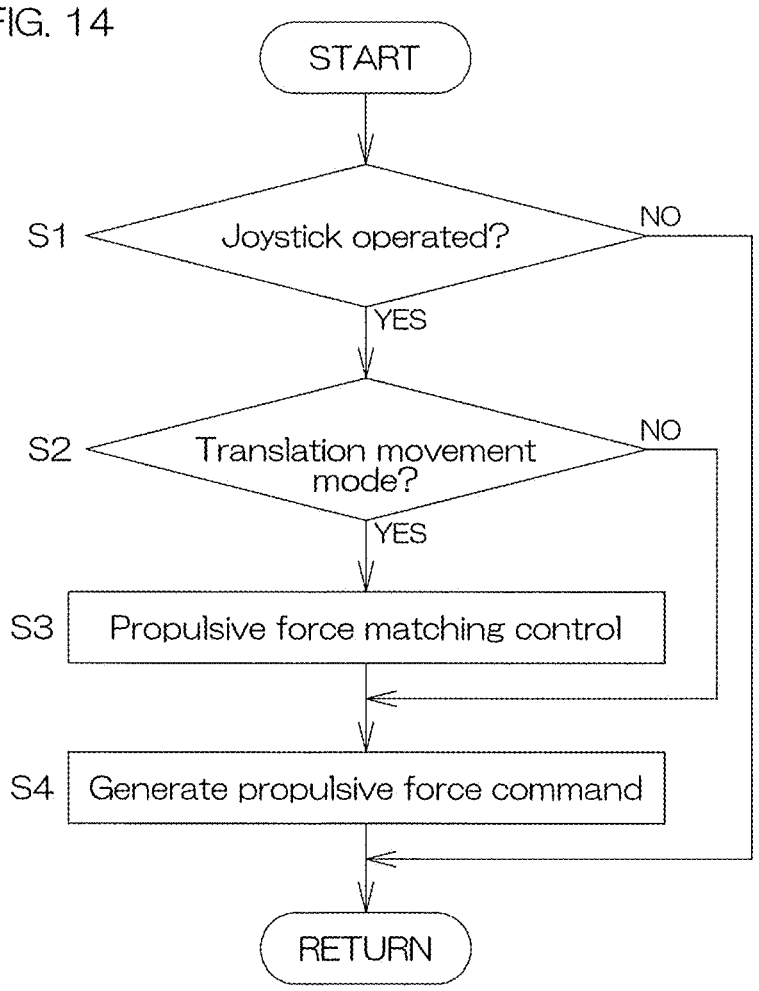
FIG. 14 is a flowchart showing an exemplary process to reduce the bow turning of the hull at the initial stage of the translation movement operation.

FIG. 14 is a flowchart showing an exemplary process to be performed by the main controller 101 to reduce the bow turning of the hull 2 at the initial stage of the translation movement operation for the lateral movement or the like. When the operation signal of the joystick 8 is inputted from the joystick unit 18 (YES in Step S1), the main controller 101 determines whether or not the control mode is a translation movement mode (Step S2). If the control mode is the translation movement mode (YES in Step S2), the main controller 101 performs a propulsive force matching control (Step S3), and generates the propulsive force command and the steering angle command (Step S4) to apply the propulsive force command and the steering angle command to the engine outboard motor OM and the electric outboard motor EM. If the control mode is not the translation movement mode (NO in Step S2), the main controller 101 generates the propulsive force command and the steering angle command (Step S4) to apply the propulsive force command and the steering angle command to the engine outboard motor OM and the electric outboard motor EM without performing the propulsive force matching control (Step S3). The propulsive force matching control (Step S3) is performed to match the propulsive force increasing characteristic of the electric outboard motor EM with the propulsive force increasing characteristic of the engine outboard motor OM in response to the operation signal of the joystick 8.

The translation movement mode is a control mode in which the hull 2 is translated in a direction corresponding to the inclination direction of the joystick 8 in response to the inclination operation of the joystick 8 (translation movement operation), and the lateral movement control operations described above are exemplary control operations to be performed in the translation movement mode. Further, the joystick unit 18 is an example of the translation commander that inputs a translation command to the main controller 101. The control operations to be performed in the translation movement mode include not only the lateral movement control operations for the lateral translation movement but also control operations for oblique forward translation movement and oblique rearward translation movement. In any case, the steering angle control operation and the output control operation are performed so that the vector RV of the resultant force of the propulsive forces generated by the engine outboard motor OM and the electric outboard motor EM passes through the turning center G. In the translation movement mode, therefore, the main controller 101 regards the inclination operation of the joystick 8 as a command to generate the propulsive forces simultaneously from the engine outboard motor OM and the electric outboard motor EM, and performs the propulsive force matching control (Step S3).

Figure 15:
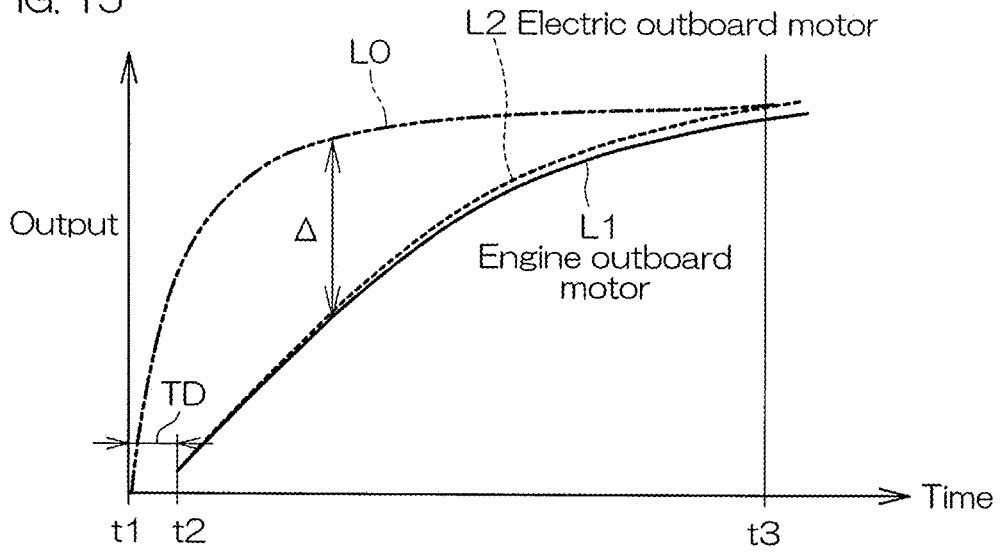
FIG. 15 is a characteristic diagram showing an example of the propulsive force matching control.

FIG. 15 shows an example of the propulsive force matching control.

In the translation movement mode, when the operation signal of the joystick 8 is inputted at time t1, the main controller 101 immediately applies the propulsive force command to the engine outboard motor OM. As described above, the propulsive force command includes the shift command that indicates the forward driving or the reverse driving, and the output command that indicates the magnitude of the propulsive force. The engine outboard motor OM starts generating the propulsive force at time t2 after a lapse of the delay time TD (also see FIG. 11) which is required for the shift-in. Then, the magnitude (output) of the propulsive force of the engine outboard motor OM increases as the engine rotation speed increases and, at time t3, reaches a propulsive force level (target output value) according to the output command (see a line L1). On the other hand, the magnitude (output) of the propulsive force of the electric outboard motor EM quickly increases to be changed as shown by a line L0 immediately after the main controller 101 applies the propulsive force command (the shift command and the output command) to the electric outboard motor EM at time t1. Thus, there is an output gap A between the propulsive force of the electric outboard motor EM and the propulsive force of the engine outboard motor OM.

To compensate for this, the main controller 101 performs the propulsive force matching control to modify the increase of the propulsive force of the electric outboard motor EM according to a characteristic line L2 conforming to the propulsive force increasing characteristic of the engine outboard motor OM. The propulsive force matching control includes a delay control to delay the increase of the propulsive force of the electric outboard motor EM. More specifically, the propulsive force matching control includes a driving start delay control (an example of the delay control) to apply the output command to the electric outboard motor EM at time t2 by delaying the application of the output command to the electric outboard motor EM for a predetermined time period T1 (substantially equal to the delay time TD) after the input of the operation signal of the joystick 8 at time t1. Further, the propulsive force matching control includes a filtering process (another example of the delay control) in which the increase of the output command is made gradual. In the filtering process, the increasing characteristic of the output command indicating the magnitude of the propulsive force of the electric outboard motor EM is gradually increased to be matched with the increase of the propulsive force of the engine outboard motor OM, i.e., the increasing characteristic of the output command is made gradual. The filtering process may be regarded as a kind of the delay process to delay the increase of the propulsive force of the electric outboard motor EM to the target propulsive force level.

These processes make it possible to cause the engine outboard motor OM and the electric outboard motor EM to simultaneously start generating the propulsive forces as having substantially the same propulsive force increasing characteristic. Therefore, the propulsive forces of the engine outboard motor OM and the electric outboard motor EM are maintained at a proper ratio even in the period before the propulsive forces of the engine outboard motor OM and the electric outboard motor EM reach the target output values (target propulsive force levels).

In the example shown in FIG. 15, the target output value (target propulsive force level) of the engine outboard motor OM and the target output value (target propulsive force level) of the electric outboard motor EM are equal to each other for easy understanding, but are not always equal to each other. This is also true for FIG. 16 to be described later.

One example of the filtering process is a step filtering process, in which a change in output command value for each control cycle of the main controller 101 is limited to a predetermined change limit value. A specific example of the step filtering process is shown below.

First step: If (Target output value)−(Output command value (previous value))≥(Change limit value), the current output command value is set to (Output command value (current value))=(Output command value (previous value)+(Change limit value).

Second step: If (Target output value)−(Output command value (previous value))<(Change limit value), the current output command value is set to (Output command value (current value))=(Target output value), and the filtering process ends.

In this process, the change in output command value for each control cycle is limited to the change limit value. Therefore, the change limit value is properly set so as to conform to the increase of the propulsive force of the engine outboard motor OM such that the increase of the propulsive force of the electric outboard motor EM can be matched with the propulsive force increasing characteristic of the engine outboard motor OM.

Another example of the filtering process is a low pass filtering process, in which a change in output command value with time is made gradual. Specifically, the main controller 101 performs the low pass filtering process as represented by the following expression to determine the output command value, and applies a propulsive force command including the output command value to the motor controller 80 of the electric outboard motor EM. The sampling rate Ts corresponds to the length of the control cycle.

$$y(t)=\{Ts*x(t)+Tc*y(t-1)\}/(Tc+Ts)$$

wherein x(t): Target output value in current control cycle t y(t): Output command value in current control cycle t Ts: Sampling rate (second)

Tc: Time constant

The change in output command value with time is made gradual by this low pass filtering process. The time constant Tc is properly set so as to conform to the increase of the propulsive force of the engine outboard motor OM such that the increase of the propulsive force of the electric outboard motor EM can be matched with the propulsive force increasing characteristic of the engine outboard motor OM.

Figure 16:
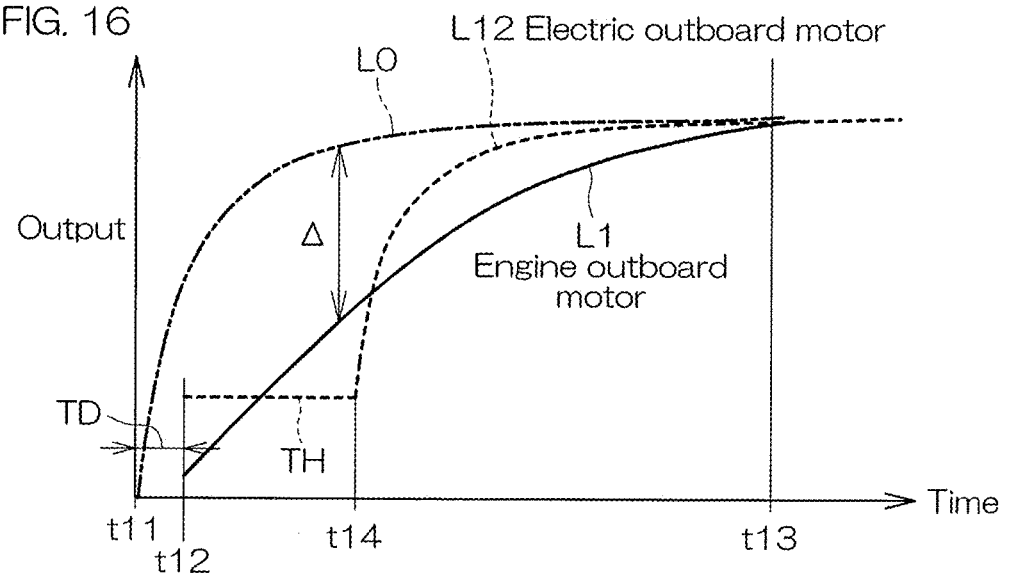
FIG. 16 is a characteristic diagram showing another example of the propulsive force matching control.

FIG. 16 shows another example of the propulsive force matching control.

When the operation signal of the joystick 8 is inputted at time t11 in the translation movement mode, the main controller 101 immediately applies the propulsive force command (the shift command and the output command) to the engine outboard motor OM. The engine outboard motor OM starts generating the propulsive force at time t12 after a lapse of the delay time TD required for the shift-in. The propulsive force of the engine outboard motor OM increases as the engine rotation speed increases and, at time t13, reaches the target output value (target propulsive force level) according to the output command (see a line L1). As in the case of FIG. 15, a line L0 shows the output increasing characteristic of the electric outboard motor EM observed when the propulsive force matching control is not performed.

The main controller 101 performs the propulsive force matching control to modify the increase of the propulsive force of the electric outboard motor EM according to a characteristic line L12 conforming to the propulsive force increasing characteristic of the engine outboard motor OM. This propulsive force matching control includes a driving start delay control (an example of the delay control) to apply the output command to the electric outboard motor EM at time t12 by delaying the application of the output command to the electric outboard motor EM for a predetermined time period T1 (substantially equal to the delay time TD) after the input of the operation signal of the joystick 8 at t11. Further, the propulsive force matching control includes an output maintaining control (another example of the delay control) to maintain the output command value at a constant level for a predetermined time period TH. Thus, the propulsive force generated by the electric outboard motor EM conforms to the characteristic line L12.

The output maintaining control is a limitation control to limit the output command so as to maintain the propulsive force of the electric outboard motor EM at an intermediate propulsive force level defined between the initial level of the propulsive force generated by the engine outboard motor OM by the shift-in and the target output value (target propulsive force level) for the predetermined time period TH. When the output maintaining control ends at time t14, the main controller 101 applies the output command to the motor controller 80 without limitation. Thus, the propulsive force of the electric outboard motor EM immediately increases to reach the target output value (target propulsive force level) at around time t13.

The driving start delay control causes the electric outboard motor EM and the engine outboard motor OM to substantially simultaneously start generating the propulsive forces. In the first half of the predetermined time period TH during which the output maintaining control is subsequently performed, the propulsive force of the electric outboard motor EM is greater than the propulsive force of the engine outboard motor OM, and a difference between the propulsive forces is gradually reduced. In the second half of the predetermined time period TH, the propulsive force of the engine outboard motor OM is greater than the propulsive force of the electric outboard motor EM. Upon completion of the output maintaining control, the propulsive force of the electric outboard motor EM increases such that a magnitude relationship between the propulsive force of the electric outboard motor EM and the propulsive force of the engine outboard motor OM is reversed again. Then, the propulsive force of the electric outboard motor EM is plateaued at the target output value (target propulsive force level). By thus performing the output maintaining control, the propulsive force increasing characteristic of the electric outboard motor EM is made closer to the propulsive force increasing characteristic of the engine outboard motor OM.

The constant level of the propulsive force to be generated by the electric outboard motor EM during the output maintaining control may be a predetermined constant level or may be a level to be set according to the target output value (target propulsive force level). Further, the predetermined time period TH during which the propulsive force of the electric outboard motor EM is maintained at the constant level by the output maintaining control may be a predetermined constant time period or may be a period having a length to be set according to the target output value (target propulsive force level). These parameters to be used in the output maintaining control are preferably set so that the propulsive forces generated by the engine outboard motor OM and the electric outboard motor EM respectively have proper integrated values in a period from the start of the generation of the propulsive forces to time t13 at which the propulsive forces are plateaued.

In the example of FIG. 16, the target output values (target propulsive force levels) for the engine outboard motor OM and the electric outboard motor EM are equal to each other. Therefore, the parameters for the output maintaining control are preferably set so that the integrated values of the propulsive forces of the engine outboard motor OM and the electric outboard motor EM in the period to time t13 are substantially equal to each other. Where the target output values (target propulsive force levels) for the engine outboard motor OM and the electric outboard motor EM are different from each other, the parameters for the output maintaining control are preferably set so that a target output value ratio is substantially equal to a ratio between the integrated values of the propulsive forces of the engine outboard motor OM and the electric outboard motor EM.

Figure 17:
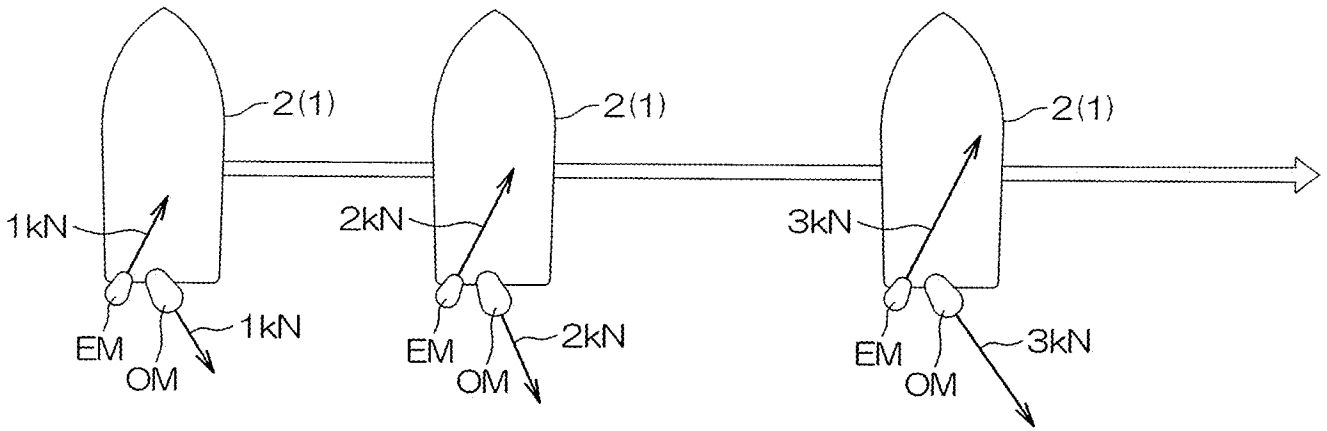
FIG. 17 is a diagram showing an exemplary hull behavior observed when the propulsive force matching control is performed.

FIG. 17 is a diagram for describing the effect of the propulsive force matching control, showing an exemplary hull behavior observed when the lateral movement control is performed. When the operator operates the joystick 8 for the lateral movement (e.g., the rightward lateral movement), the engine outboard motor OM and the electric outboard motor EM are respectively steered to steering angles for the lateral movement, and respectively generate the propulsive forces for the lateral movement. Since the propulsive force increasing characteristics of the engine outboard motor OM and the electric outboard motor EM are matched with each other by the propulsive force matching control, the vector RV of the resultant force of the propulsive force of the engine outboard motor OM and the propulsive force of the electric outboard motor EM is constantly parallel to the transverse direction of the hull 2 in the propulsive force increasing period. In the example of FIG. 17, the propulsive force commands respectively applied to the engine outboard motor OM and the electric outboard motor EM are such that the output commands (target output values) each indicating the magnitude of the propulsive force are set to 3 kN, for example. Immediately after the operation of the joystick 8, the outputs of the engine outboard motor OM and the electric outboard motor EM are gradually increased in synchronism and substantially simultaneously reach the target output values (3 kN, for example). Thus, the vector RV of the resultant force extends parallel to the transverse direction of the hull 2 (see FIG. 10A), and the action line 203 of the vector RV passes through the turning center G, so that the hull 2 is able to translate laterally. Thus, the propulsive force of the engine outboard motor OM and the propulsive force of the electric outboard motor EM have substantially the same magnitude even in the increasing period, and reach their target propulsive force levels at substantially the same time. Thus, the bow turning of the hull 2 is prevented which may otherwise occur due to the propulsive force imbalance immediately after the lateral movement operation is started. Thus, the hull behavior of the lateral movement in the intended direction is achieved.

While preferred embodiments of the present invention have thus been described, the invention may be embodied in some other ways.

In a preferred embodiment described above, the main controller 101 performs the propulsive force matching control by way of example. Alternatively, the motor controller 80 of the electric outboard motor EM may perform the propulsive force matching control in the same manner. In this case, the main controller 101 does not perform the process shown in FIG. 14 but, instead, applies control mode information to the motor controller 80. The motor controller 80 determines whether or not the control mode of the main controller 101 is the translation movement mode. If the control mode is the translation movement mode, the propulsive force matching control is performed. If the control mode is not the translation movement mode, the propulsive force matching control is not performed. When the electric outboard motor EM is driven in response to the propulsive force command applied from the main controller 101, the motor controller 80 controls the drive signal of the electric motor 61 so as to match the propulsive force increasing characteristic of the electric outboard motor EM with the propulsive force increasing characteristic of the engine outboard motor OM. In this example, the main controller 101 and the motor controller 80 each correspond to the controller in the present invention.

In the propulsive force matching control shown in FIG. 15, both the driving start delay control and the filtering process are performed, but one of the driving start delay control and the filtering process may be performed as the propulsive force matching control.

In the propulsive force matching control shown in FIG. 16, both the driving start delay control and the output maintaining control are performed, but one of the driving start delay control and the output maintaining control may be performed as the propulsive force matching control.

After the output maintaining control (see FIG. 16), the filtering process (see FIG. 15) may be performed. In this case, the driving start delay control may be performed before the output maintaining control.

In a preferred embodiment described above, the watercraft propulsion system includes the engine outboard motor and the electric outboard motor by way of example. The present invention is applicable to a watercraft propulsion system including a first propulsion device and a second propulsion device having different output increasing characteristics (i.e., respectively having a first propulsive force increasing characteristic and a second propulsive force increasing characteristic). In this case, when both the first propulsion device and the second propulsion device are to be driven, the first propulsive force increasing characteristic and the second propulsive force increasing characteristic may be matched with each other by performing the propulsive force matching control. Thus, the same effects as in the above-described preferred embodiments can be provided. For example, both the first propulsion device and the second propulsion device may be electric propulsion devices, or may be engine propulsion devices. Further, three or more propulsion devices may be provided in the watercraft propulsion system.

The propulsion devices are not necessarily required attachable to the stern 3, but an auxiliary propulsion device such as a trolling motor may be attached to the bow or other portion of the hull.

In a preferred embodiment described above, the outboard motors are used as the propulsion devices by way of example, but inboard motors, inboard/outboard motors (stern drives), waterjet propulsion devices and other forms of propulsion devices may be used.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

an engine propulsion device attachable to a hull and including a propeller rotatable about a first propeller axis;

an electric propulsion device attachable to the hull and including a propeller rotatable about a second propeller axis different from the first propeller axis; and a controller configured or programmed to control the engine propulsion device and the electric propulsion device and, when a command is inputted to cause the engine propulsion device and the electric propulsion device to simultaneously generate propulsive forces, to perform a propulsive force matching control to match a propulsive force increasing characteristic of the electric propulsion device with a propulsive force increasing characteristic of the engine propulsion device; wherein the propulsive force matching control includes a delay control to delay an increase of the propulsive force of the electric propulsion device.

2. The watercraft propulsion system according to claim 1, wherein the propulsive force matching control further includes a filtering process in which the propulsive force increasing characteristic of the electric propulsion device is gradual.

3. A watercraft propulsion system comprising:

an engine propulsion device attachable to a hull and including a propeller rotatable about a first propeller axis;

an electric propulsion device attachable to the hull and including a propeller rotatable about a second propeller axis different from the first propeller axis; and a controller configured or programmed to control the engine propulsion device and the electric propulsion device and, when a command is inputted to cause the engine propulsion device and the electric propulsion device to simultaneously generate propulsive forces, to perform a propulsive force matching control to match a propulsive force increasing characteristic of the electric propulsion device with a propulsive force increasing characteristic of the engine propulsion device; wherein the propulsive force matching control includes a driving start delay control to delay a driving start timing of the electric propulsion device.

4. The watercraft propulsion system according to claim 3, wherein the propulsive force matching control further includes a filtering process in which the propulsive force increasing characteristic of the electric propulsion device is gradual after driving of the electric propulsion device is started.

5. A watercraft propulsion system comprising:

an engine propulsion device attachable to a hull and including a propeller rotatable about a first propeller axis;

an electric propulsion device attachable to the hull and including a propeller rotatable about a second propeller axis different from the first propeller axis; and a controller configured or programmed to control the engine propulsion device and the electric propulsion device and, when a command is inputted to cause the engine propulsion device and the electric propulsion device to simultaneously generate propulsive forces, to perform a propulsive force matching control to match a propulsive force increasing characteristic of the electric propulsion device with a propulsive force increasing characteristic of the engine propulsion device; wherein the propulsive force matching control includes a limitation control to maintain the propulsive force of the electric propulsion device at a constant propulsive force level that is lower than a target propulsive force level for a predetermined time period after driving of the electric propulsion device is started.

6. The watercraft propulsion system according to claim 1, further comprising:

a translation command input to input a translation command to the controller to translate the hull; wherein the controller is configured or programmed to perform the propulsive force matching control when the translation command is inputted from the translation command input.

7. The watercraft propulsion system according to claim 1, wherein the engine propulsion device and the electric propulsion device are attachable to a stern of the hull.

8. A watercraft comprising:

a hull; and the watercraft propulsion system according to claim 1 provided on the hull.

9. A watercraft comprising:

a hull; and the watercraft propulsion system according to claim 3 provided on the hull.

10. A watercraft comprising:

a hull; and the watercraft propulsion system according to claim 5 provided on the hull.

11. The watercraft propulsion system according to claim 3, further comprising:

a translation command input to input a translation command to the controller to translate the hull; wherein the controller is configured or programmed to perform the propulsive force matching control when the translation command is inputted from the translation command input.

12. The watercraft propulsion system according to claim 3, wherein the engine propulsion device and the electric propulsion device are attachable to a stern of the hull.

13. The watercraft propulsion system according to claim 5, further comprising:

a translation command input to input a translation command to the controller to translate the hull; wherein the controller is configured or programmed to perform the propulsive force matching control when the translation command is inputted from the translation command input.

14. The watercraft propulsion system according to claim 5, wherein the engine propulsion device and the electric propulsion device are attachable to a stern of the hull.

* * * * *